US007963889B2

(12) United States Patent
Badarneh et al.

(10) Patent No.: US 7,963,889 B2
(45) Date of Patent: Jun. 21, 2011

(54) INDOOR EXERCISE CYCLE WITH TILT FUNCTION

(75) Inventors: Ziad Badarneh, Oslo (NO); Campbell Ellis, Oslo (NO); Benedict J. M. Hansen, Oslo (NO)

(73) Assignee: Ziad Badarneh, Oslo (NO)

( * ) Notice: Subject to any disclaimer, the term of this patent is extended or adjusted under 35 U.S.C. 154(b) by 0 days.

(21) Appl. No.: 12/092,800

(22) PCT Filed: Nov. 7, 2006

(86) PCT No.: PCT/NO2006/000398

§ 371 (c)(1),
(2), (4) Date: May 6, 2008

(87) PCT Pub. No.: WO2007/055584

PCT Pub. Date: May 18, 2007

(65) Prior Publication Data

US 2008/0269025 A1 Oct. 30, 2008

(30) Foreign Application Priority Data

| | | |
|---|---|---|
| Nov. 8, 2005 | (NO) | 20055233 |
| Jan. 31, 2006 | (NO) | 20060487 |
| Apr. 26, 2006 | (NO) | 20061853 |
| Jul. 10, 2006 | (NO) | 20063194 |

(51) Int. Cl.
*A63B 22/06* (2006.01)
*A63B 22/00* (2006.01)

(52) U.S. Cl. ..... 482/57; 482/61

(58) Field of Classification Search ..... 482/57–65
See application file for complete search history.

(56) References Cited

U.S. PATENT DOCUMENTS

| | | | | |
|---|---|---|---|---|
| 3,750,479 | A * | 8/1973 | Gause et al. | 73/379.07 |
| 4,957,282 | A | 9/1990 | Wakefield | |
| 5,785,631 | A * | 7/1998 | Heidecke | 482/5 |
| 6,120,416 | A * | 9/2000 | Walker | 482/57 |
| 6,126,577 | A | 10/2000 | Chang | |
| 6,135,930 | A * | 10/2000 | Kuo | 482/72 |
| 6,547,702 | B1 * | 4/2003 | Heidecke | 482/62 |
| 6,551,219 | B1 * | 4/2003 | Brown | 482/57 |
| 6,648,802 | B2 * | 11/2003 | Ware | 482/57 |
| 7,326,151 | B2 * | 2/2008 | Peterson et al. | 482/61 |
| 7,481,746 | B2 * | 1/2009 | Ibarguren | 482/57 |
| 7,682,286 | B2 * | 3/2010 | Badarneh et al. | 482/5 |
| 7,717,824 | B2 * | 5/2010 | Pinto | 482/7 |
| 2002/0004439 | A1 * | 1/2002 | Galbraith et al. | 482/57 |
| 2004/0077465 | A1 * | 4/2004 | Schmidt | 482/57 |
| 2007/0105694 | A1 * | 5/2007 | Panatta | 482/57 |
| 2008/0269025 | A1 * | 10/2008 | Badarneh et al. | 482/57 |
| 2009/0048076 | A1 * | 2/2009 | Irving et al. | 482/57 |
| 2009/0170667 | A1 * | 7/2009 | Irving et al. | 482/57 |
| 2010/0081548 | A1 * | 4/2010 | Labedz et al. | 482/4 |

FOREIGN PATENT DOCUMENTS

| | | | |
|---|---|---|---|
| EP | 0 354 785 | A2 | 2/1990 |
| EP | 0 947 224 | A2 | 10/1999 |
| WO | 03/018391 | A3 | 3/2003 |
| WO | 2005/046806 | A2 | 5/2005 |
| WO | WO 2005/046806 | | 5/2005 |

* cited by examiner

*Primary Examiner* — Steve R Crow
(74) *Attorney, Agent, or Firm* — Rodman & Rodman

(57) ABSTRACT

A cycle apparatus for physical exercise, rehabilitation of injuries and increased balance, the apparatus designed as a stationary exercise cycle. The apparatus consist of a first lower stable frame configured to be supported on a floor and a second upper frame rotary connected on axle fixed cantilever on first frame. The upper frame has an adjustable tilt movement relative the lower frame crosswise the flywheel's revolving motion. Stabilizing of the upper frame is done by turning handlebars.

8 Claims, 20 Drawing Sheets

Figure 1:
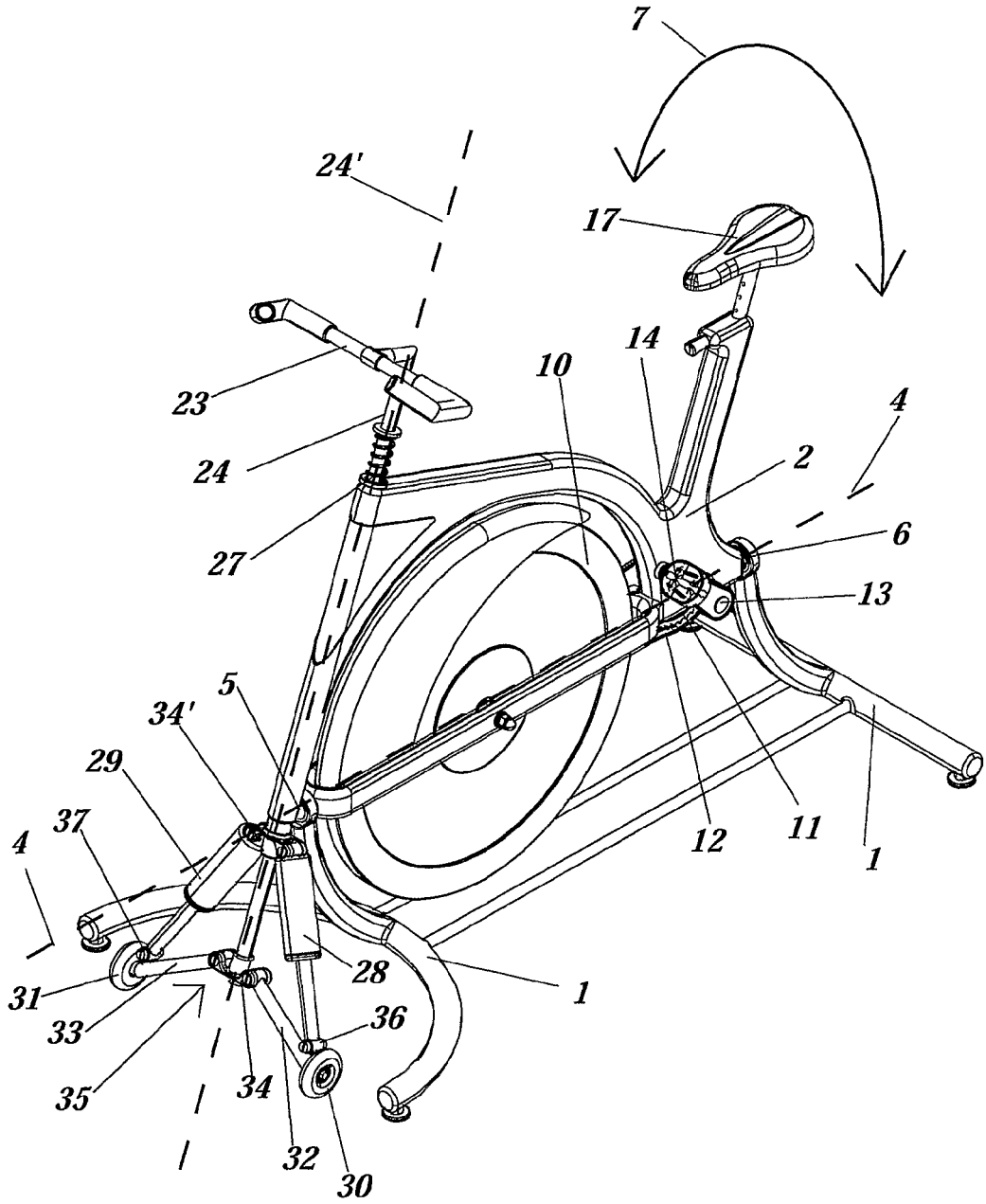
Fig. 1 Prior art

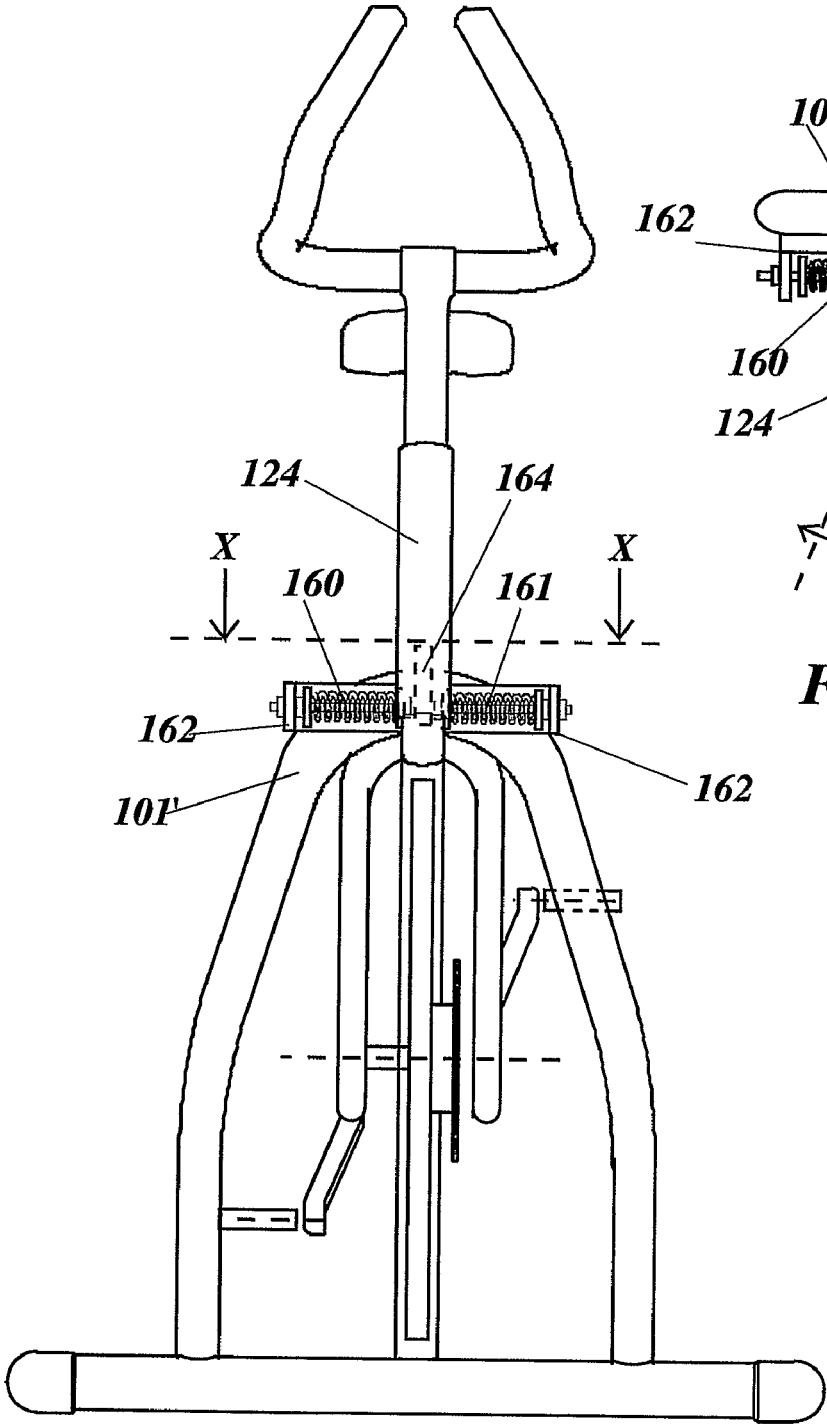
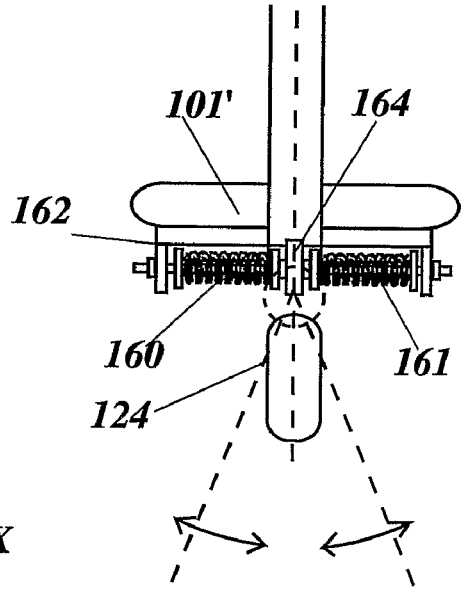
Fig. 10
Fig. 9

INDOOR EXERCISE CYCLE WITH TILT FUNCTION

This invention relates to a training apparatus for exercise and rehabilitation of a person's muscles and is especially adapted to designs, which are related to principles of training during instability and controlling balance when performing a training exercise.

This invention represents a new design and function for an indoor exercise cycle. The cycle is unstable tiltable with a system for controlling the instability, simulating a feeling of riding an ordinary mobile bicycle.

It is a common fact that bicycle riding, is of great benefit for most humans. It combines cardiovascular exercise with strength of muscles (mainly lower body) and the overall balance system of the human being. Most humans need an activity where balance and body control is required be it activities of dance, climbing, skiing, surfing, hang-gliding, kayaking, bicycle riding etc. The brain's balance control system needs to challenge the muscles, which make the human body achieve multiple physical tasks. There are "small" muscular elements in the body, which affects the larger muscle groups to perform better if challenged to controlled instability during activity, training and exercise.

PCT application with publication number WO2005/046806, discloses a training apparatus for physical exercise, preventive exercise and rehabilitation of injuries and increased balance, the apparatus designed as a stationary exercise cycle, similar to ergometer cycles or spinning cycles or bikes. The apparatus consists of a first lower stable frame configured to be supported on a floor and a second upper frame tiltable relative to the lower frame. The upper frame has an adjustable tilt movement relative to the lower frame crosswise the flywheel's revolving motion. A steering gear is guided through the upper frame where a prolonged part of the steering gear is in contact with the floor, the part having a wheel suspension-like design, consisting of bar-links, dampers, springs and wheels. Stabilizing of the upper frame is done by movement of the steering gear.

The described apparatus of prior art does however present a few problems. The construction of the steering with front suspension is rather complicated and represents a costly part of the apparatus. The suspension rests on the same floor surface as the frame. As the suspension has rotating wheels or balls which should move, this puts certain demands to the smoothness of the floor surface, making the apparatus of this prior art perform less satisfactory if the floor is tiled, stoned, covered with a carpet, being boarded with cracks or uneven areas, rough concrete etc. Another problem with the prior art is that the axis of tilt is placed rather low and suggests a very unsteady apparatus.

The present invention will show improvements of the above described prior art, the motion achieved utilizing the same principle but using a different method and mechanical construction to achieve the wanted effect of simulating a natural biking experience.

As such the inventor wants to show how a complete exercise cycle apparatus is designed with functions of controlled instability to stimulate a user's strength and which provide the user with advantages in regards to rehabilitation and prevention of injuries, and provide means for increasing balancing skills.

Figure 2A:
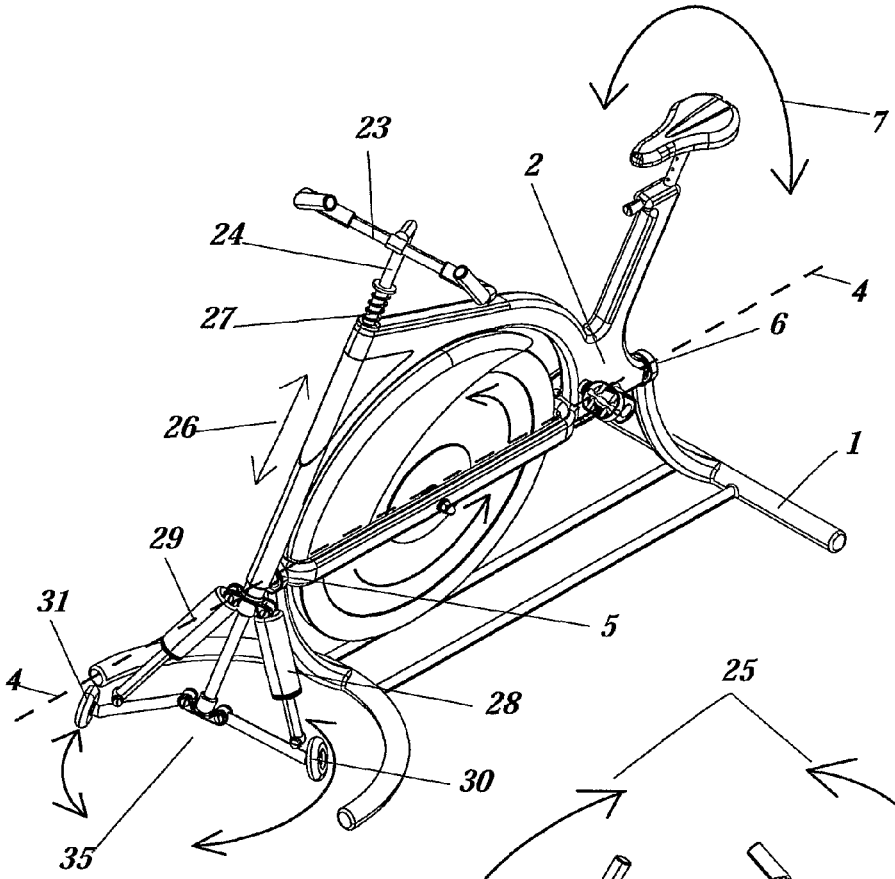
Fig. 2a Prior art
Figure 2B:
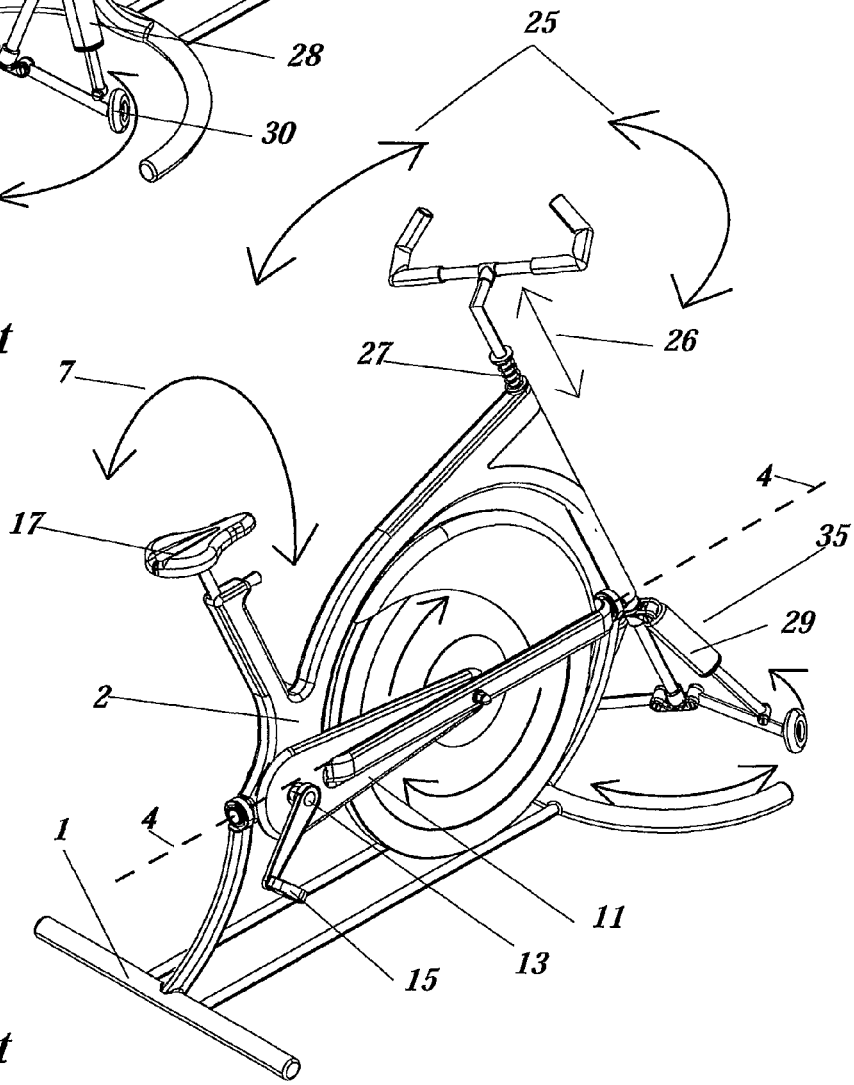
Fig. 2b Prior art
Figure 3:
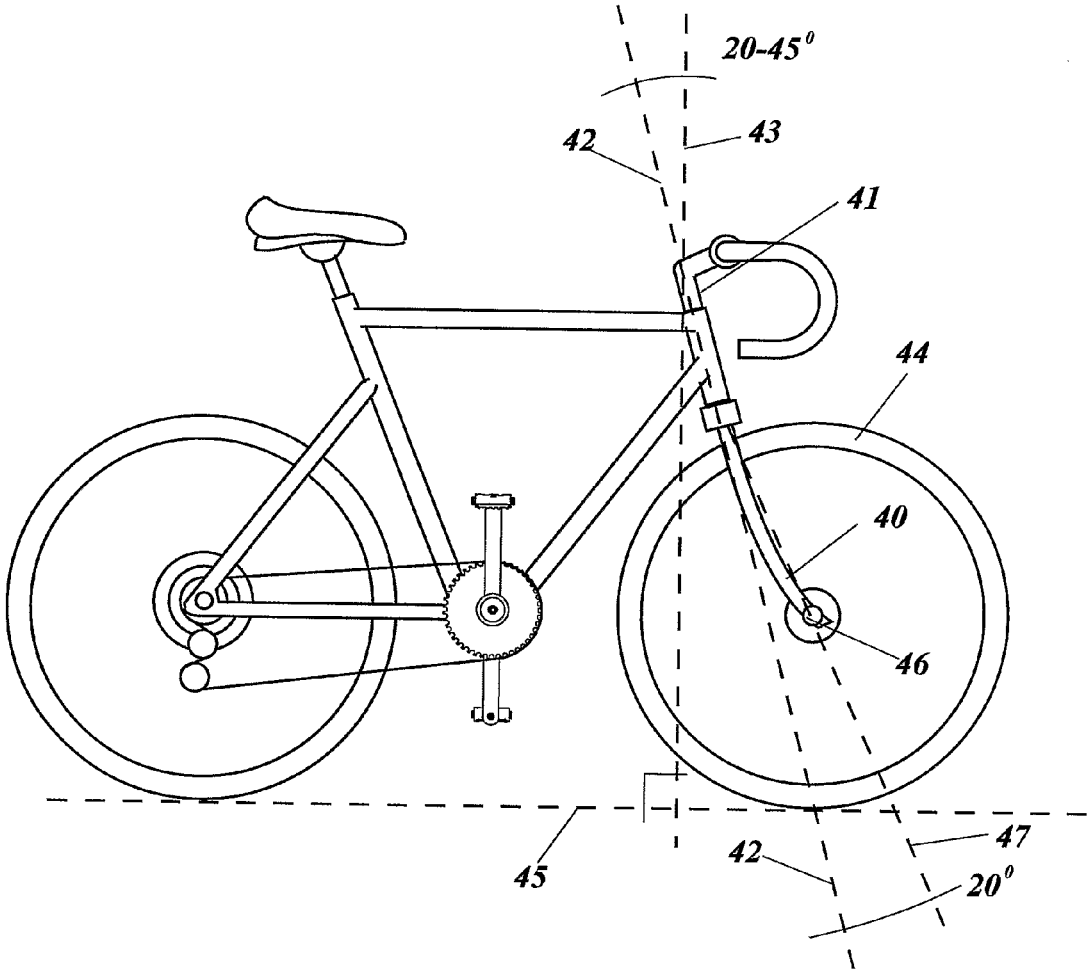
Figure 4:
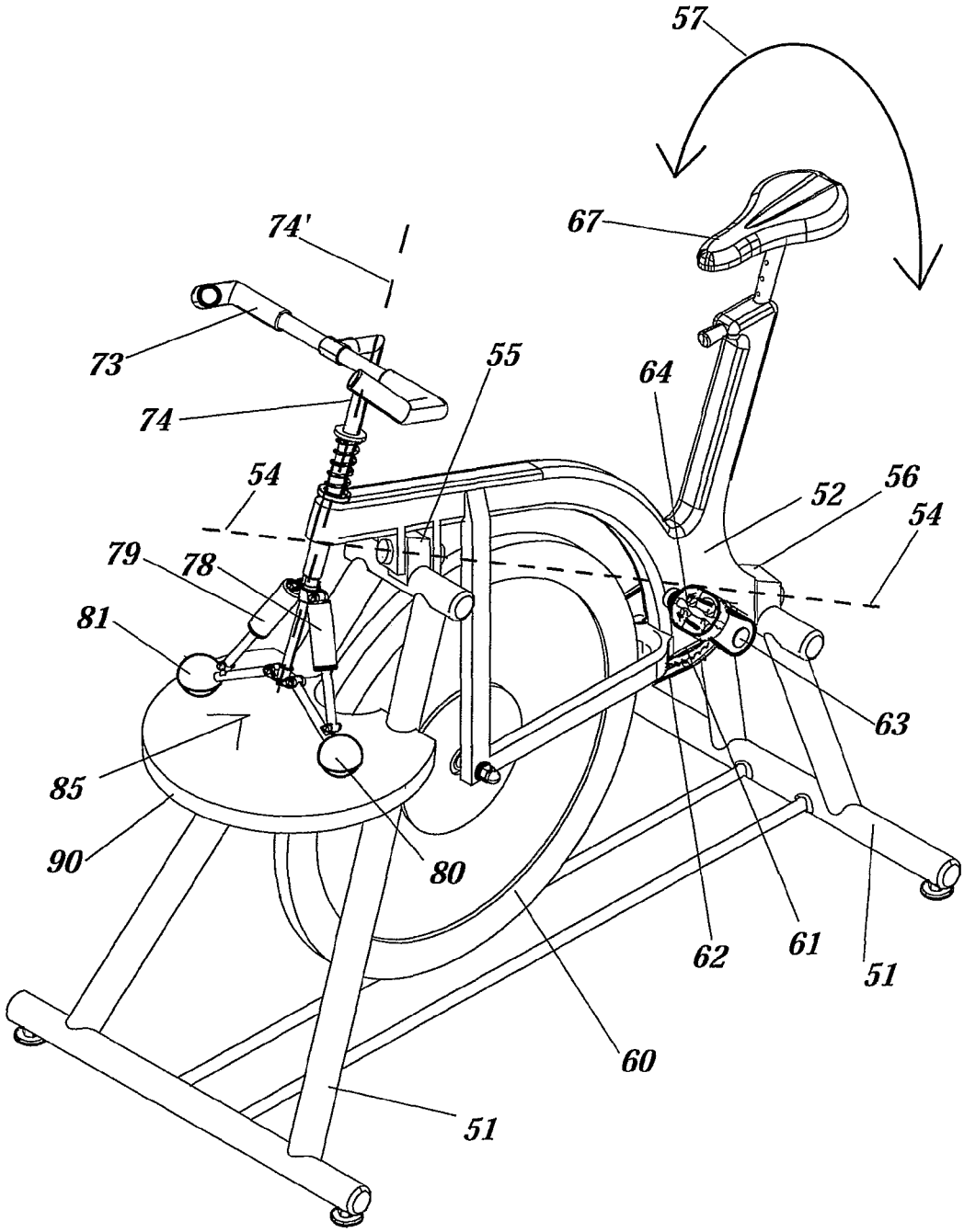
Figure 5A:
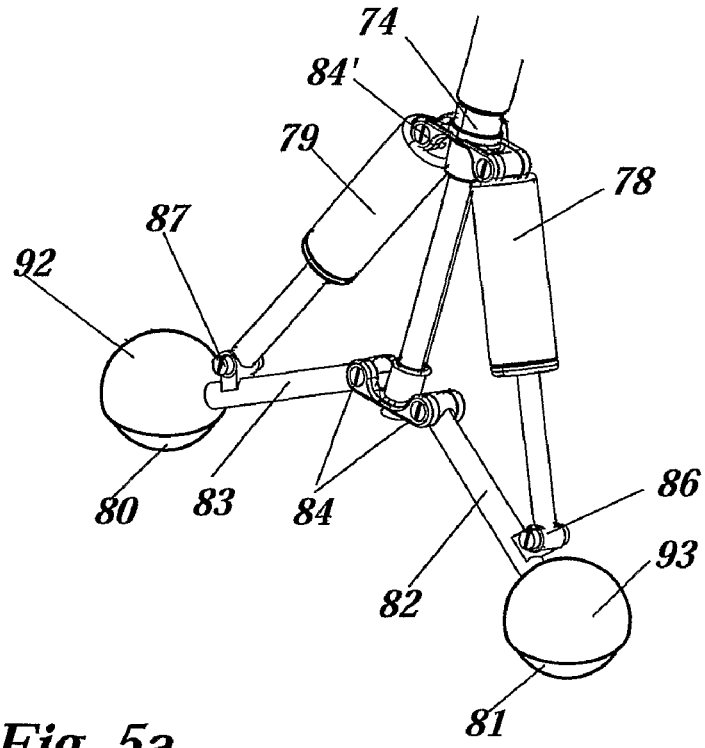
Figure 5B:
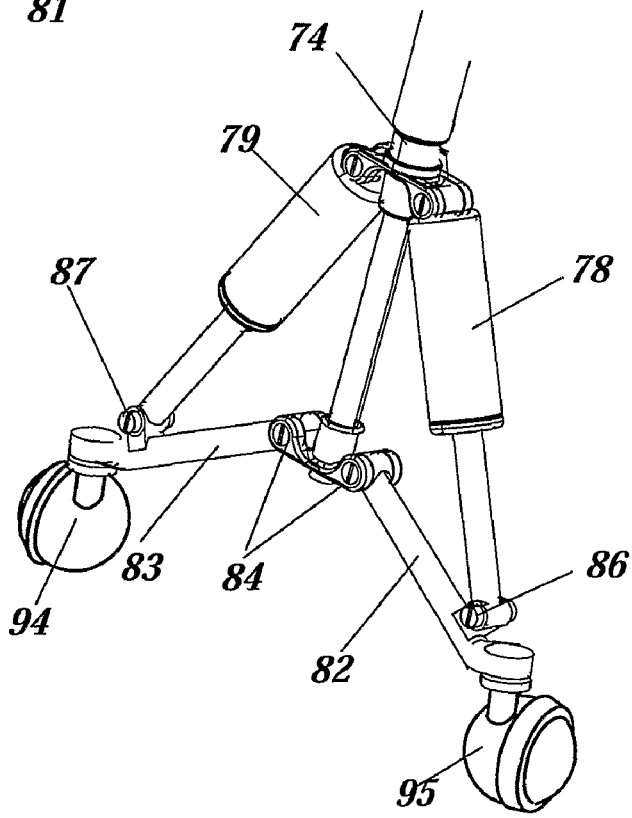
Figure 6:
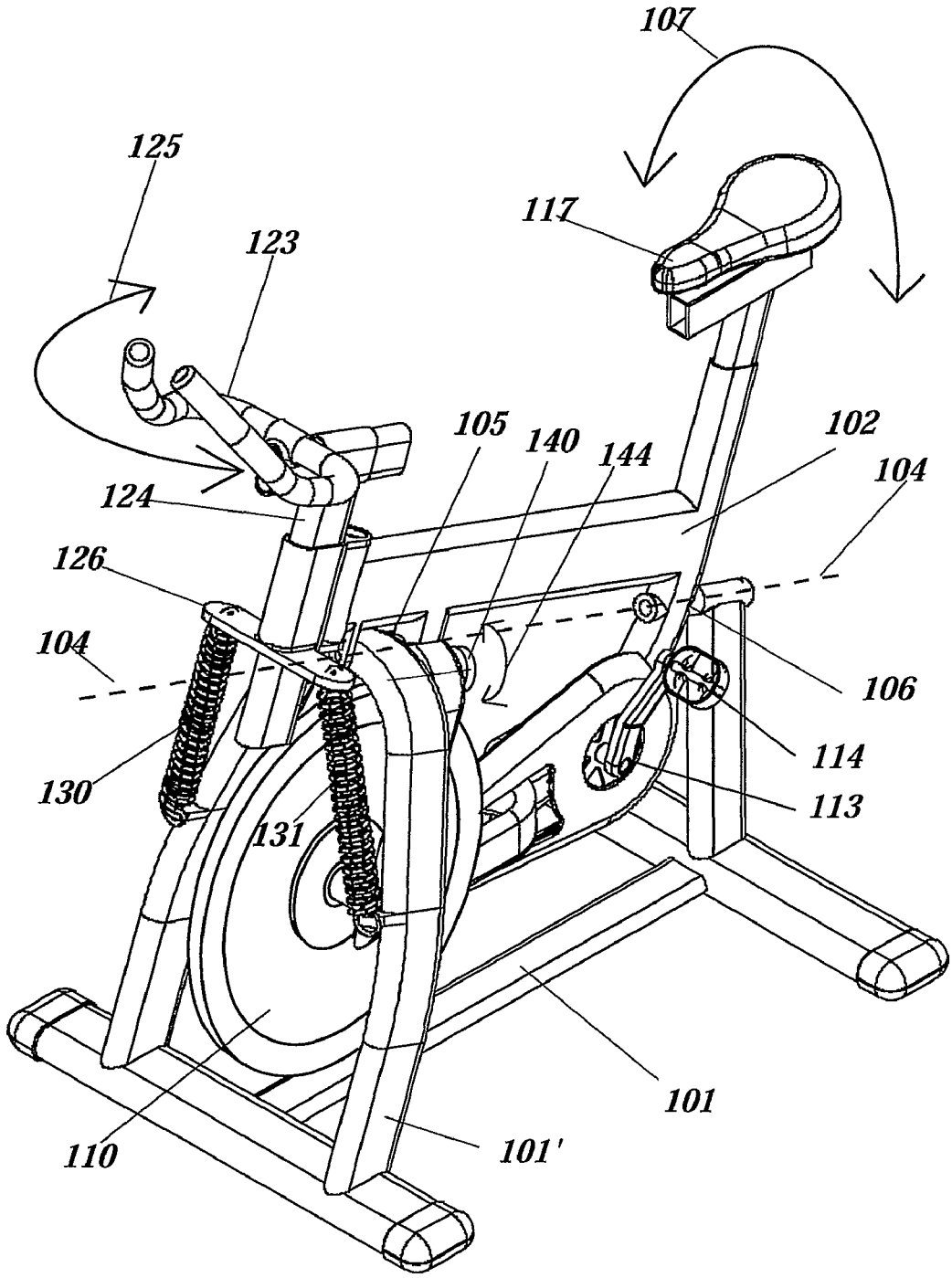
Figure 7:
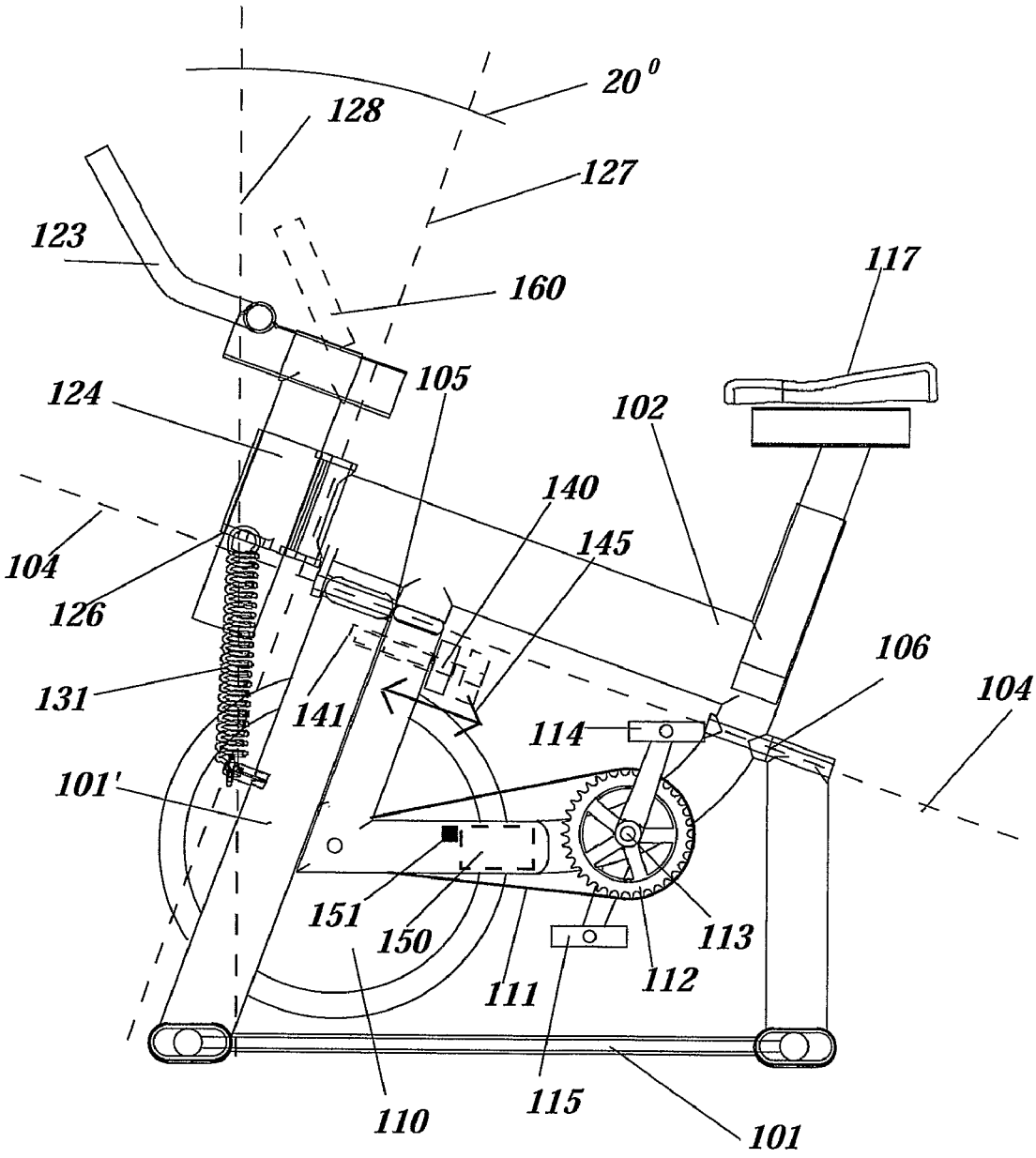
Figure 8:
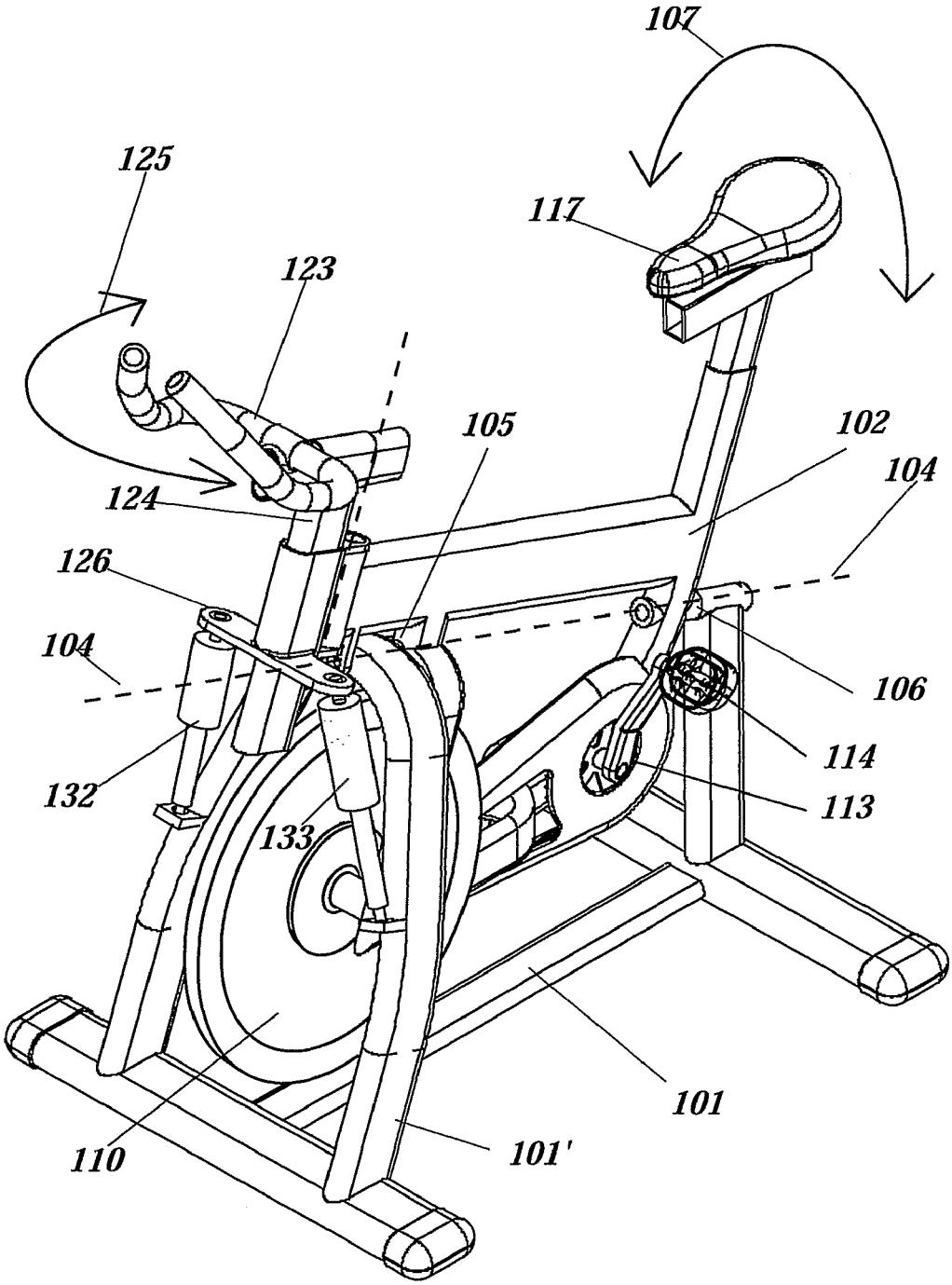
Figure 11:
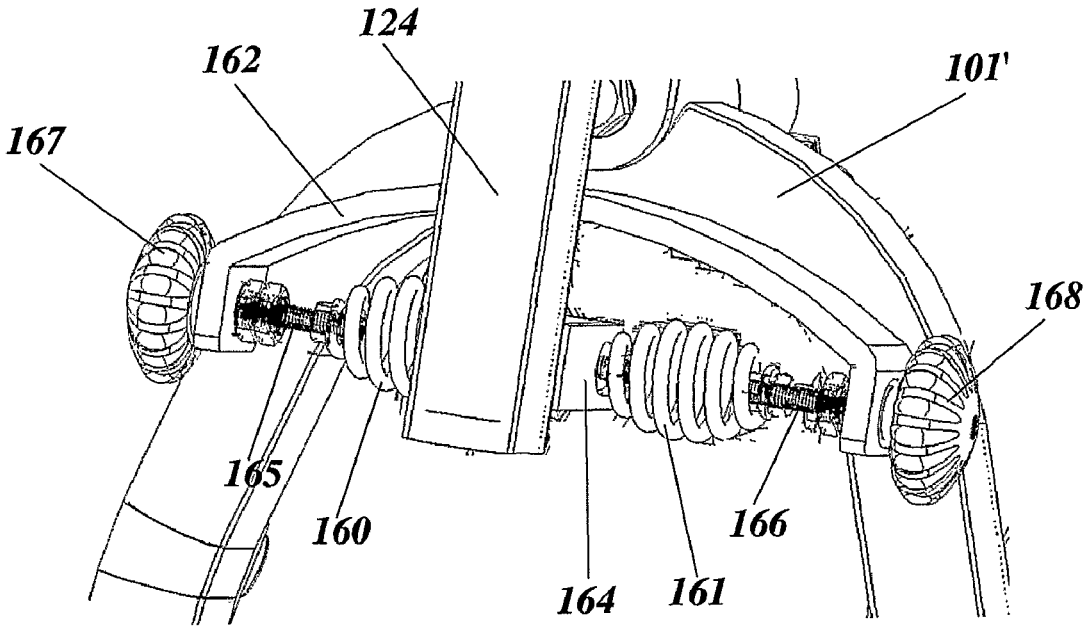
Figure 12:
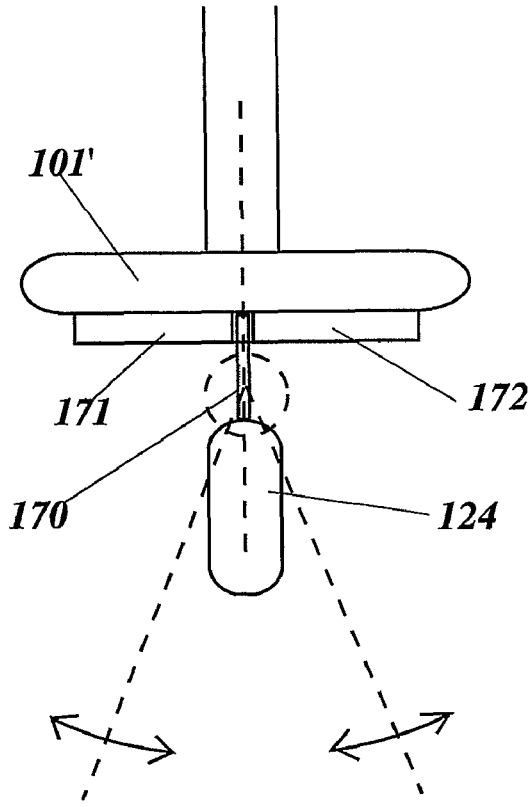
Figure 13:
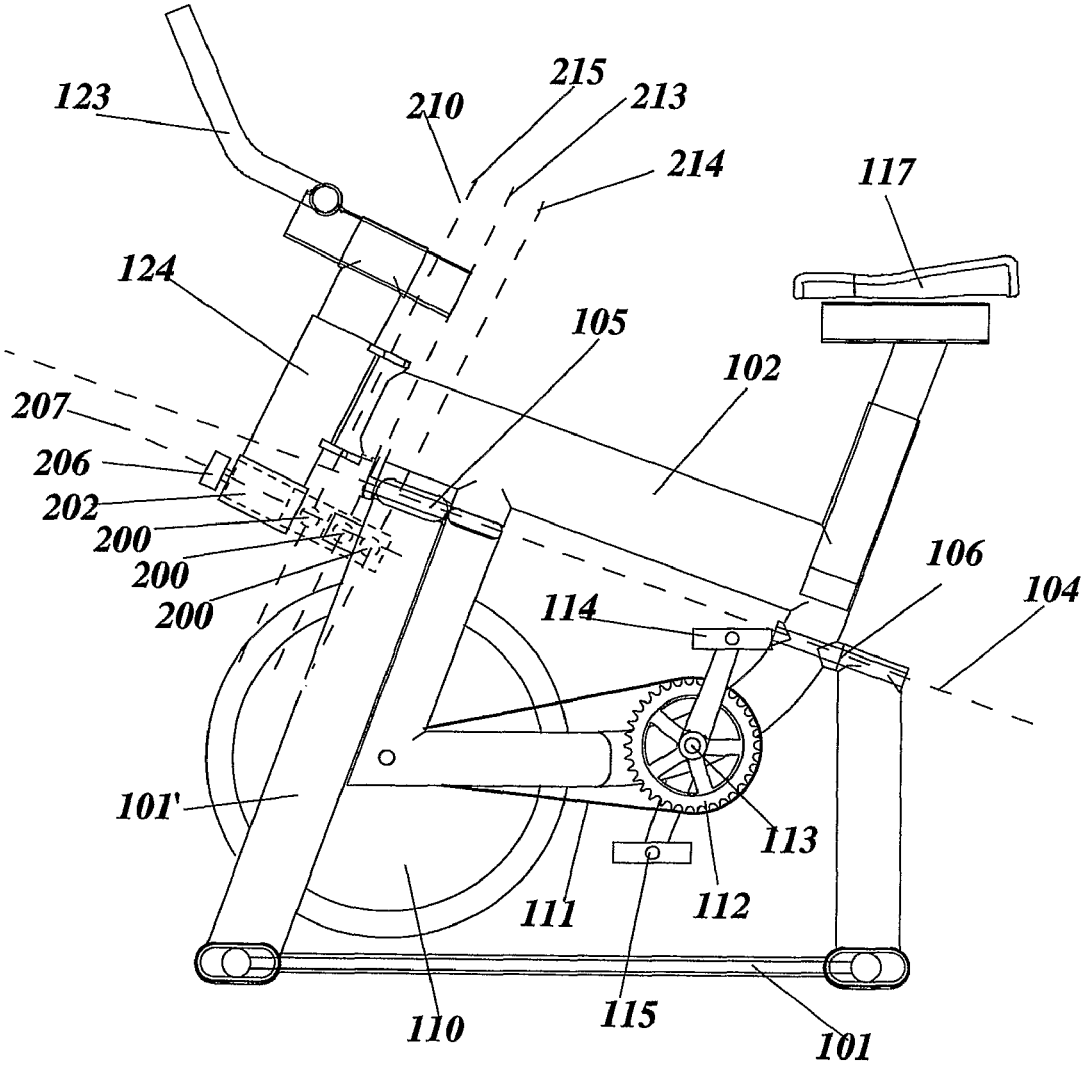
Figure 14A:
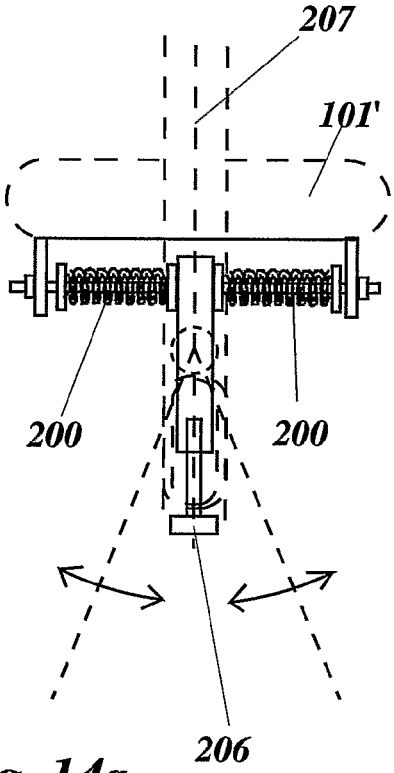
Figure 14B:
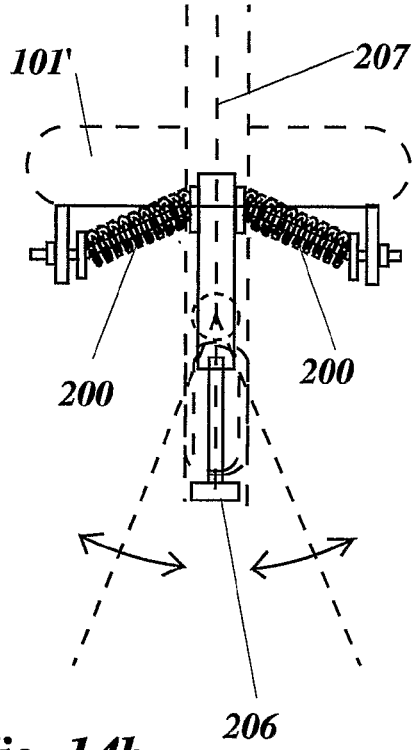
Figure 14C:
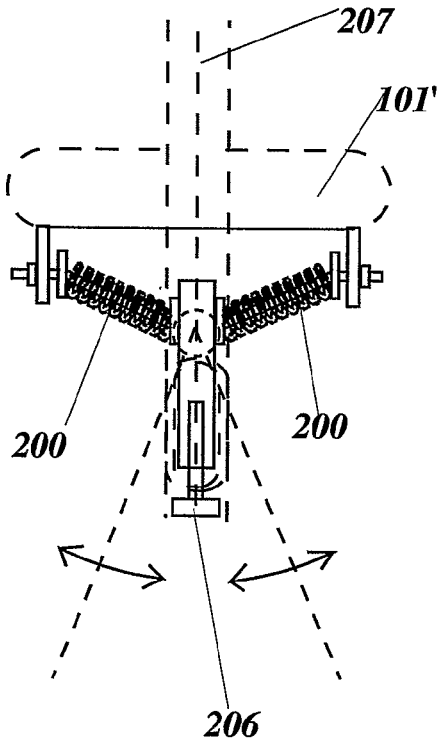
Figure 15:
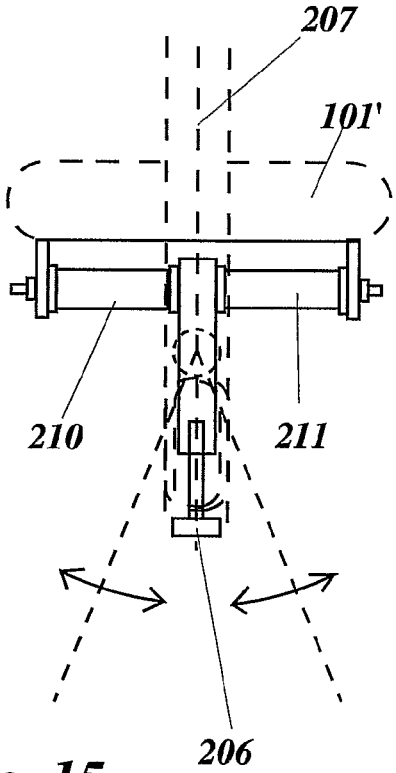
Figure 16A:
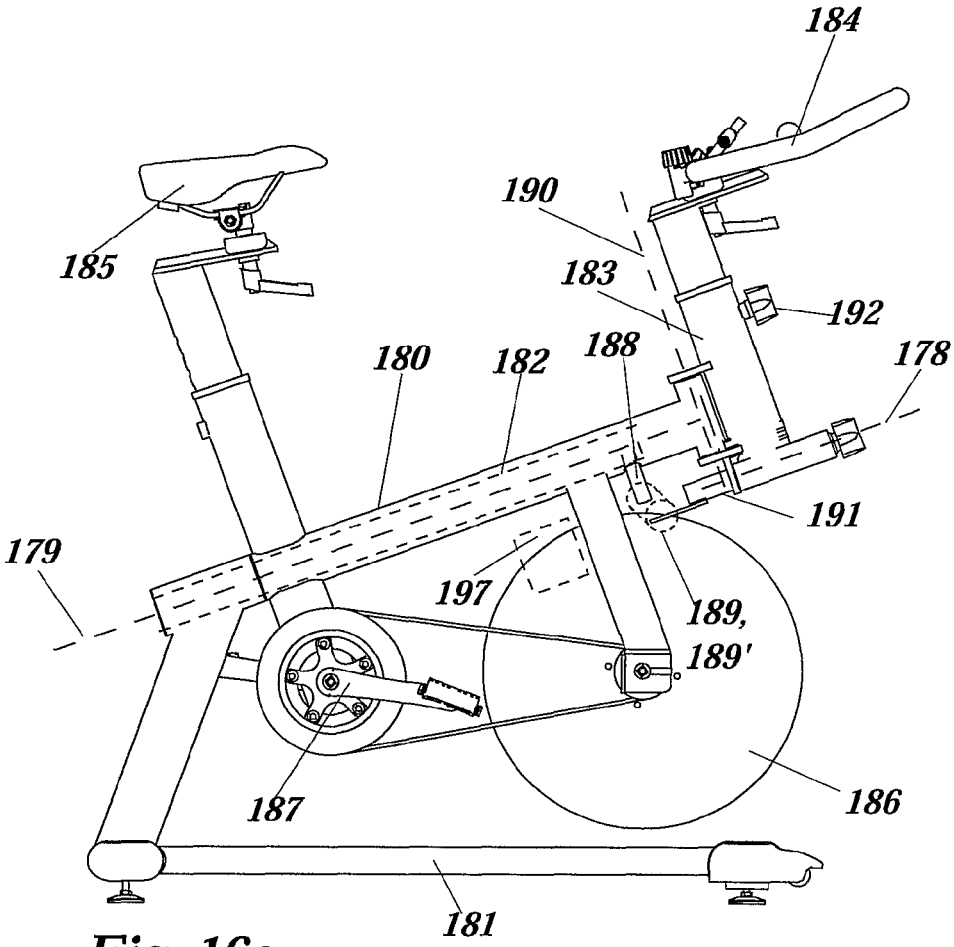
Figure 16B:
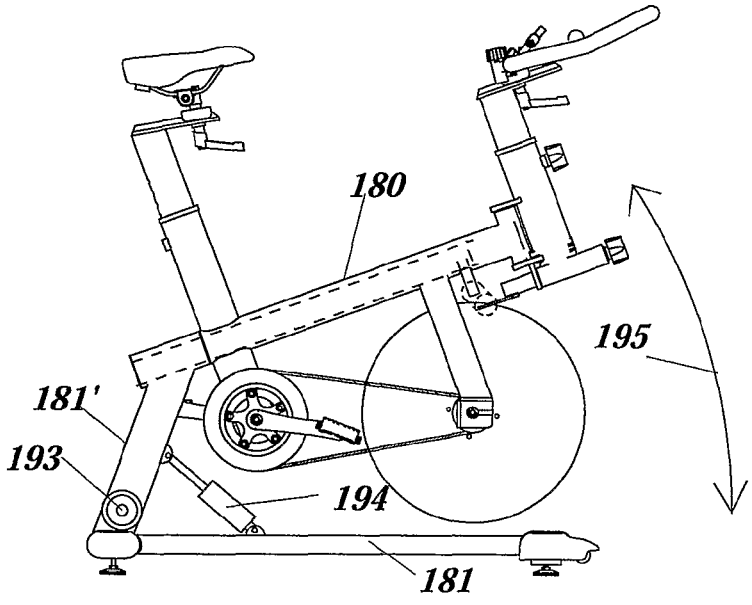
Figure 17:
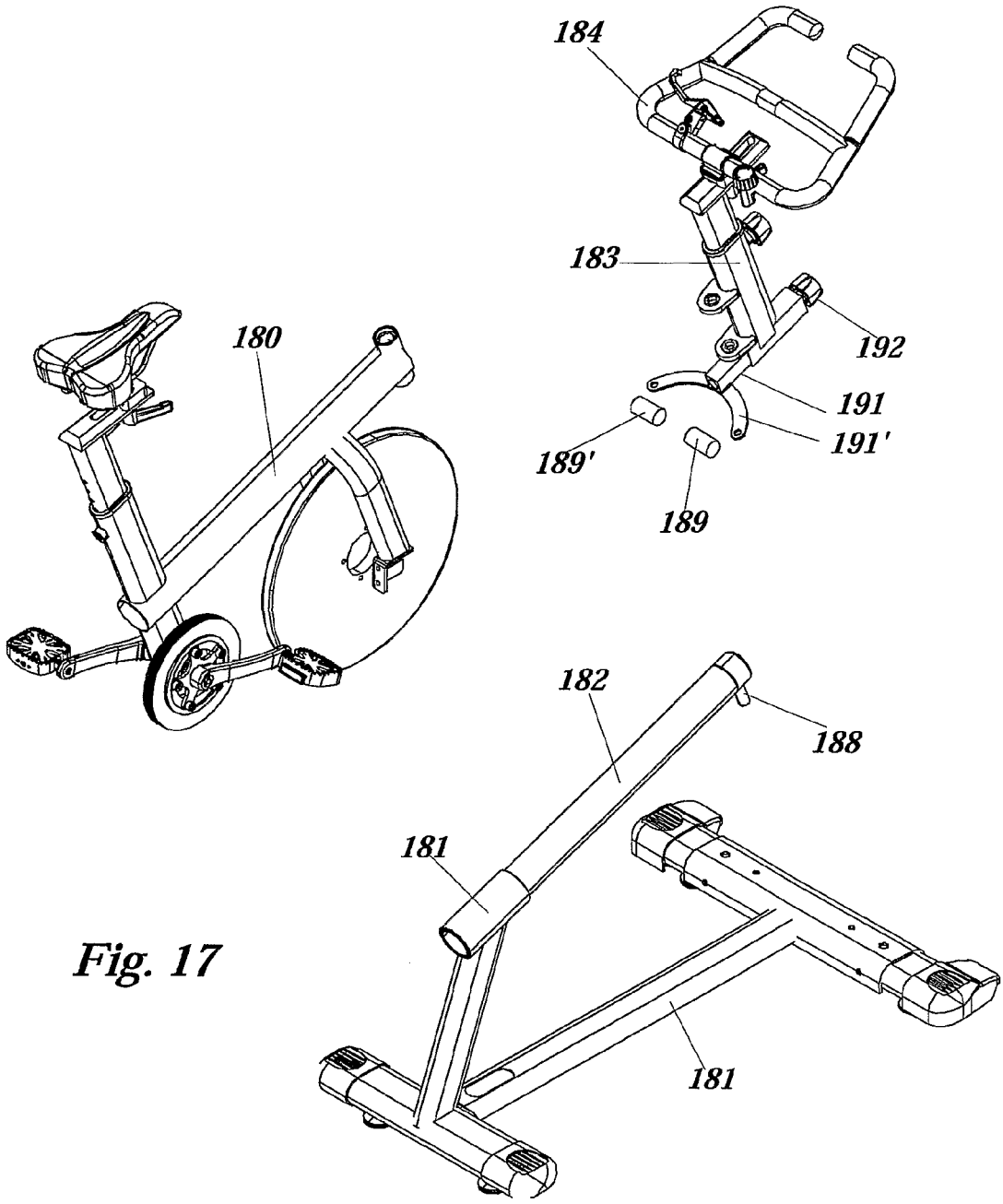
Figure 18:
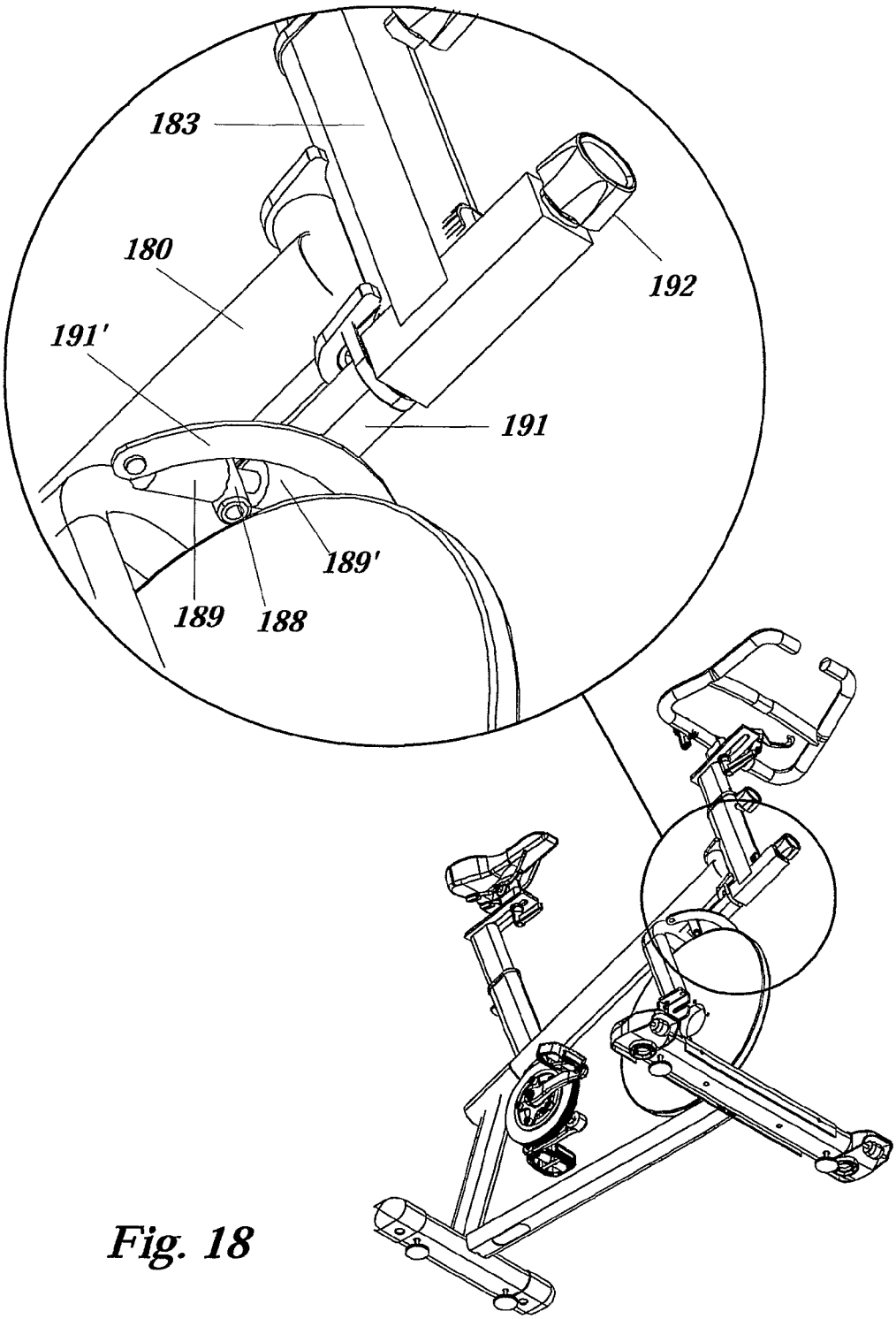
Figure 19A:
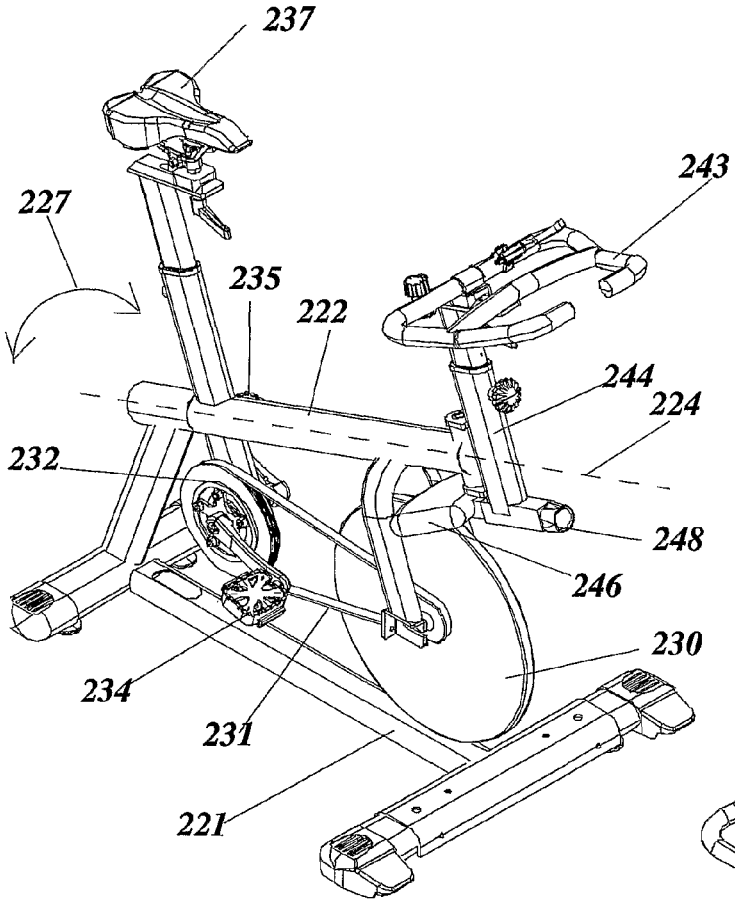
Figure 19B:
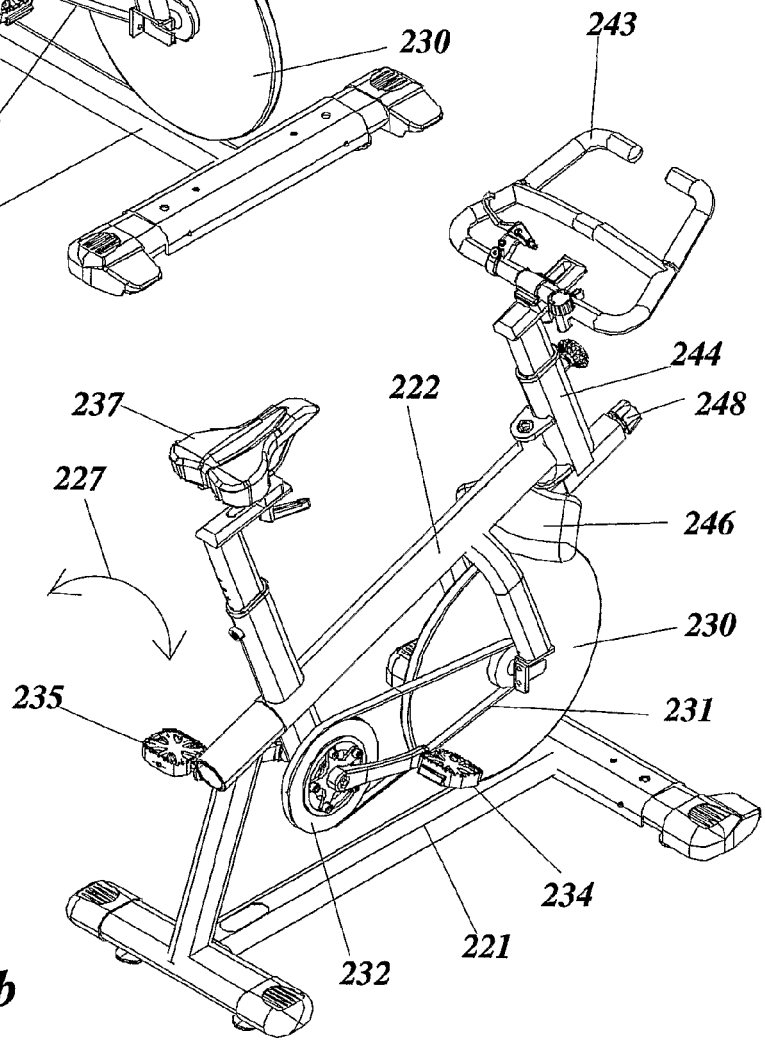
Figure 20A:
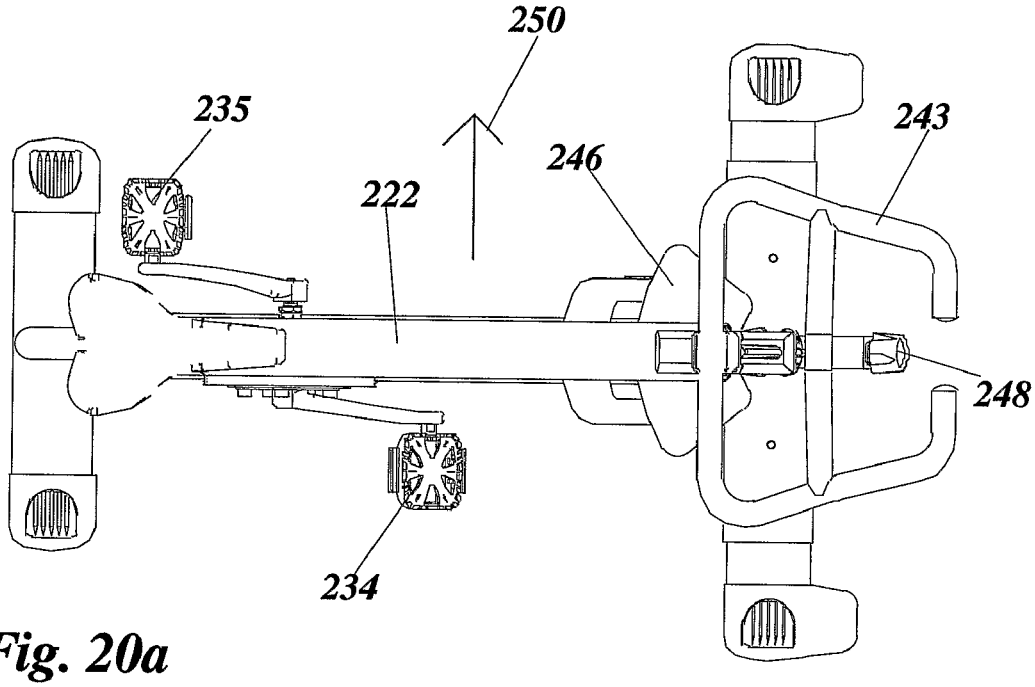
Figure 20B:
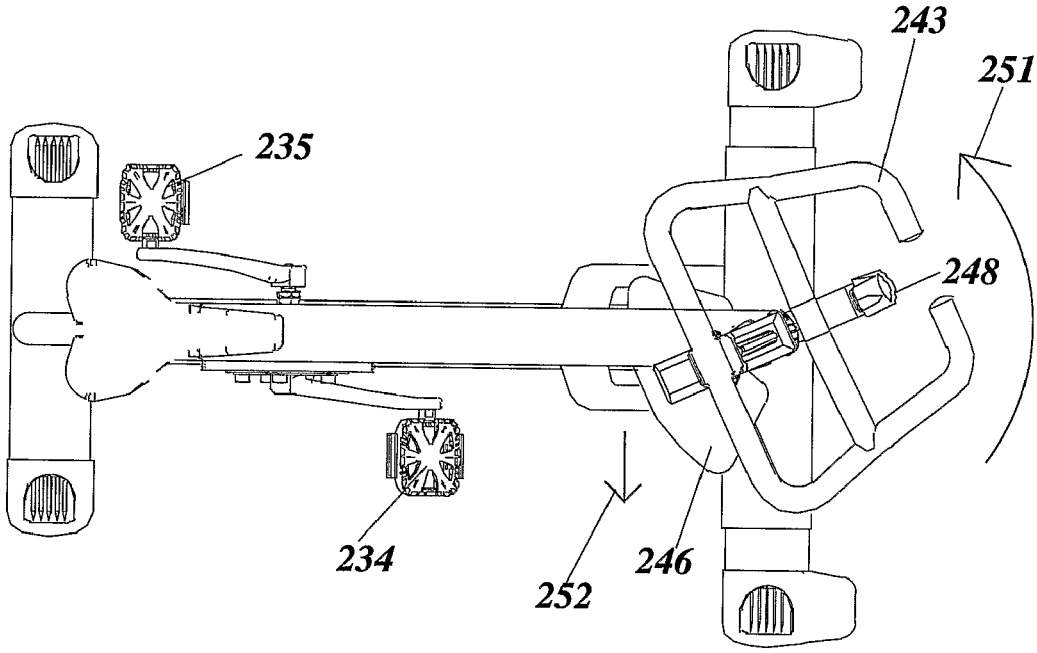
Figure 21:
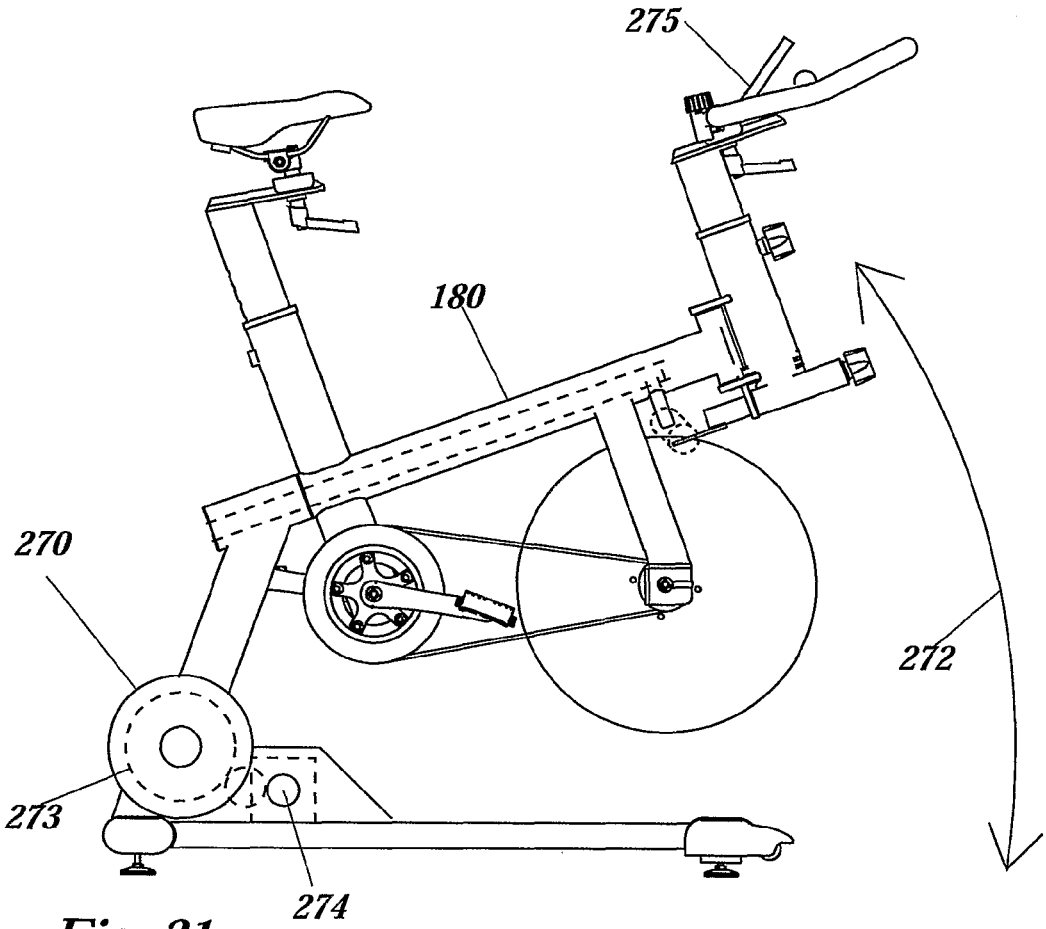
Figure 22:
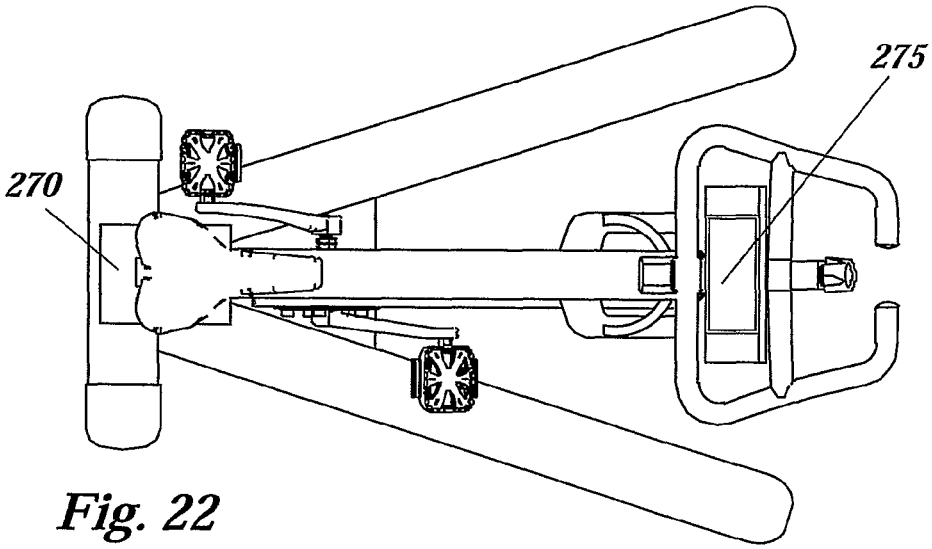
Figure 23:
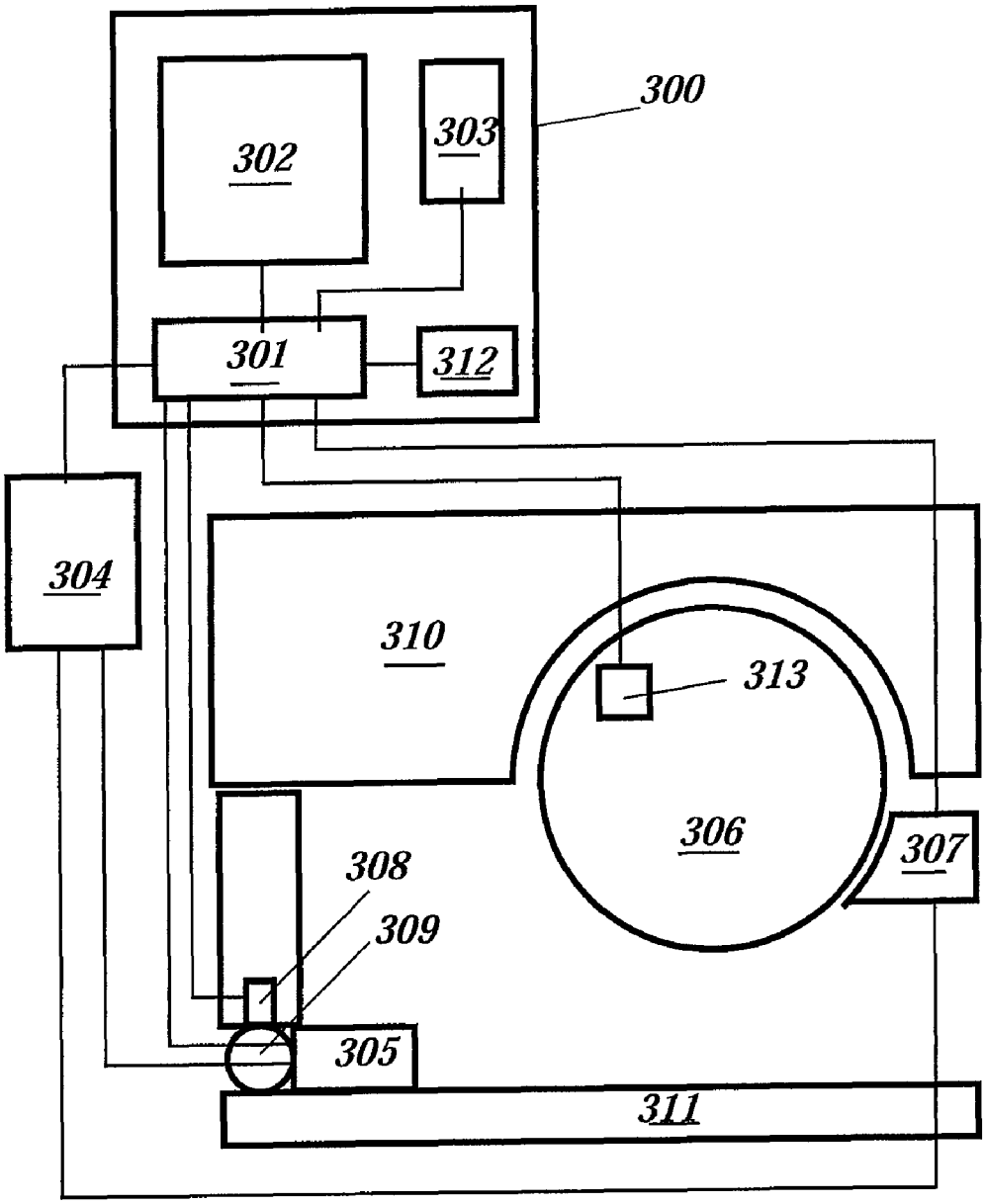
Figure 24A:
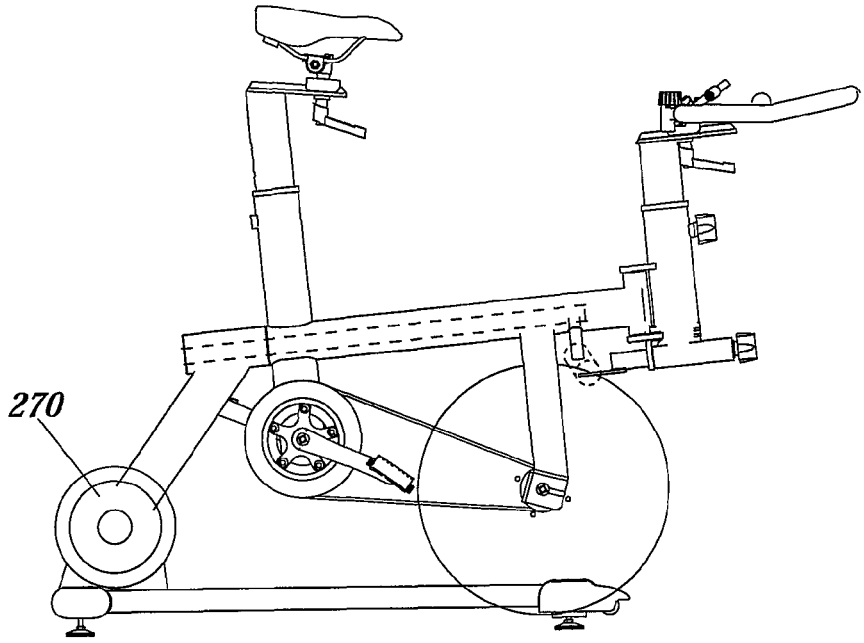
Figure 24B:
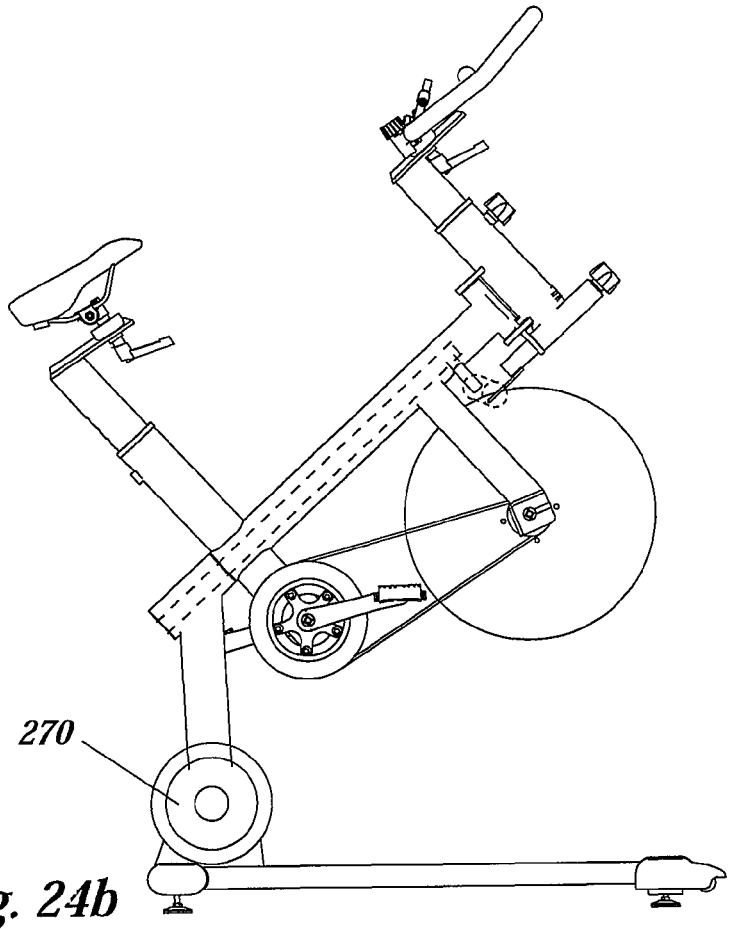

The features of the invention will be described with reference to accompanying drawings, which illustrates preferred embodiments of the invention by example and in which;

FIG. 1 shows a perspective view of an exercise cycle apparatus according to prior art, FIGS. 2*a*-2*b* show the functionality of the prior art, FIG. 3 illustrates principles related to a bicycle and the present invention, FIG. 4 shows a first embodiment of a cycle apparatus according to the invention, FIGS. 5*a*-5*b* show details regarding stabilisation of cycle shown in FIG. 4, FIG. 6 shows a perspective view of a second embodiment of a cycle apparatus according to the invention, FIG. 7 shows a side view of the embodiment shown in FIG. 6, FIG. 8 shows a variation to the second embodiment of the invention, FIGS. 9, 10 and 11 show variations of a spring mechanism incorporated in a third embodiment of the invention, FIG. 12 shows yet another spring variation, FIG. 13-14*a*-*c* shows an adjustment mechanism for adjustment of tilt action when using springs as shown in FIG. 9-11, FIG. 15 shows a spring mechanism and an adjustment mechanism for adjustment of tilt action when using springs made of rubber, FIG. 16*a* shows a side view according to a fourth embodiment of the invention and FIG. 16*b*. shows a variation of this, FIG. 17 shows an exploded view of the fourth embodiment, FIG. 18 shows details of the fourth embodiment, FIGS. (19*a*-19*b*) and (20*a*-20*b*) shows a fifth embodiment according to the invention, FIGS. 21 and 22 show a side view and top view of an indoor cycle apparatus, representing a sixth embodiment of the invention, FIG. 23 shows a block schematic of the invention, FIG. 24*a*-24*b* show variation of cycle as seen in FIGS. 21, 22 in two different positions.

FIG. 1 shows a stationary indoor exercise cycle apparatus of the prior art, including a first lower frame 1 stable relative to a floor, which supports a second upper frame 2, which is tiltably attached to the first frame 1. As shown in FIGS. 2 and 3 the second upper frame 2 is tiltable through axis 4 relative to the first lower frame and the floor. Bearings (not shown) connecting the two frames 1 and 2 are positioned in the forward 5 and rear 6 part of the frames, the bearings being of for example slide bearings, pin or ball bearings. Tilt motion is indicated by arrow 7. A flywheel 10 is rotationally fastened to the upper frame 2 connected to drive means, as a belt or a chain 11 which via a cog or sprocket 12 transfers motion to the flywheel through a crank 13 with pedals 14 and 15. The drive means are mechanically similar to that of bicycles and prior art and are therefore not shown in more detail on the figures and thus will not be commented on any further. A seat 17 is fixed on the upper frame 2 in a familiar manner.

The system of balance control and stabilisation of the cycle apparatus according to the prior art will now be described with reference to FIGS. 2*a*-2*b*. As shown in FIGS. 2*a*-2*b*, the apparatus has a steering gear and handlebar 23 where a steering rod 24 is able to turn as indicated by arrows 25, and moveable in the direction of length as indicated by arrow 26, relative to the upper frame 2. To the lower part of and on two sides of the steering rod 24 is movably fastened two cylindrical dampers 28 and 29, the dampers either being of hydraulic type or gas type. Two wheels 30 and 31 are rotatably fastened on linkage bars 32 and 33, which are hinged on two sides and at the end portion of steering rod 24 in joint 34. Dampers 28 and 29 are located between steering rod 24, at joint 34', and to linkage bars 32 and 33 at joints 36 and 37. This forms a movable wheel suspension like unit 35, where wheels 30 and 31 always are in contact with the floor. Further shown on FIG. 2*b* the steering rod 24 is also slideable relative to the upper frame 2 as indicated by arrow 26, where this movement is resilient, the rod being in connection with spring 27.

FIGS. 2*a* and 2*b* shows the cycle in a tilted situation where steering gear is turned towards the direction of tilt. In use the top frame 2 of the cycle will tend to tilt to one or the other direction. As for a mobile bicycle with two wheels a user will turn the handlebar 23 in the direction the upper frame 2 tends to tilt so to balance the frame in an upright position, the wheels 31 and 30 of the suspension unit 35, are at all times in contact with the floor. Dampers 28 and 29 provide flexibility, instability and tilt motion to the upper frame 2, the movements controlled by turning steering gear 23 and thus suspension unit 35. Tilt of the upper frame 2 compresses one of the dampers 28 or 29 and extends the other. Turning the steering gear forces to further shorten one of the dampers, but when the damper is fully compressed, further turning of steering gear will make the damper force the upper frame 2 back up in an upright position.

The exercise cycle is most unstable when the flywheel 10 is static or is slowly revolving. When speed of revolution increases the gyroscopic effect of the flywheel will provide a stabilising effect of the exercise cycle, and the need for stabilising the tilt movement of the upper frame 2 by turning of the handlebar is at a minimum. A user may also stabilize the exercise cycle by distributing its weight on either side of the frame sitting or standing whilst pedaling. The use is in other words familiar to anyone mastering the technique of using any two-wheeled mobile bicycle.

As illustrated by FIG. 3 anyone familiar with the principle art of balancing a bicycle would know that the fork 40 and steering rod 41 rotational axis 42 is at an angle normally 20-45 degrees between the steering rod 41 (which the fork 40 and front wheel 44 is fixed to) and a vertical axis 43 relative to the line of travel (of the bicycle) representing a horizontal line or axis 45 (though seldom a straight line from a bird perspective). The axis 46 of front wheel rotation is again at approximately 20-degree angle (axis 47) relative to axis 42.

The motion of the front wheel of a bicycle when turning the steering rod and fork is simulated in the prior art where steering rod 24 axis 24' is approximately positioned 20 degrees relative to a 90 degree vertical axis.

As disclosed in the above description and FIGS. 1 to 2*a*-2*b* the front suspension configuration of the prior art apparatus is dependent being placed on a flat and even floor surface. The present invention will disclose a solution where the steering mechanics is lifted from the floor working relative to the stable part of the frame and not dependent on current floor or surface of floor thus avoiding the problems discussed above.

FIG. 4 shows a first embodiment of the invention representing an indoor stationary exercise cycle, including a first lower frame 51 stable relative to a floor, which supports a second upper frame 52, which is tiltably attached to the first frame 51. The second upper frame 52 is tiltable through axis 54 relative to the first lower frame and the floor, bearings (not shown) connecting the two frames 51 and 52 are positioned in the forward 55 and rear 56 part of the frames, the bearings being of for example slide bearings, pin or ball bearings. Tilt motion is indicated by arrow 57. A flywheel 60 is rotatably fastened to the upper frame 52 connected to drive means, as a belt or a chain 61 which via a cog or sprocket 62 transfers motion to the flywheel through a crank 63 with pedals 64 and 65 (not visible). The drive means are mechanically similar to that of bicycles and prior art and are therefore not shown in more detail on the figures and thus will not be commented any further. A seat 67 is fixed on the upper frame 52 in a familiar manner.

The apparatus has a steering gear and handlebar 73 where a steering rod 74 is able to turn as indicated by arrows 75, relative to the frames 51, 52, frame 52 having a board 90 of which wheel suspension device 85 works. To the lower part of and on two sides of the steering rod 74 is movably fastened two cylindrical dampers 78 and 79, the dampers either being of hydraulic type or gas type. With reference to FIGS. 4 and 5*a*-5*b*, two wheels or rollers 80, 80' and 81, 81' are rotatably fastened on linkage bars 82 and 83, which are moveable, hinged on two sides and at end portion of steering rod 74 in joint 84. Dampers 78 and 79 are located between steering rod 74, at joint 84', and to linkage bars 82 and 83 at joints 86 and 87. This forms a movable wheel suspension like unit 85, where wheels 80, 80' and 81, 81' are in contact with board 90.

FIG. 5*a* show the suspension unit 85 with balls 80 and 81, which are positioned in cup like supports 92 and 93. FIG. 5*b* shows suspension unit with turn able wheels 94 and 95, similar to that found on office chairs.

FIGS. 6-7 show a second embodiment of the invention representing an indoor stationary exercise cycle, including a first lower frame 101 stable relative to a floor, which supports a second upper frame 102, which is tiltable attached to the first frame 101. The second upper frame 102 is tiltable through axis 104 relative to the first lower frame and the floor, bearings (not shown) connecting the two frames 101 and 102 are positioned in the forward 105 and rear 106 part of the frames, the bearings being of for example slide bearings, pin or ball bearings. The front connecting point 105 is higher from the floor than the rear connecting point 106, which gives the tilt axis 104 an incline relative to the floor. Tilt motion is indicated by arrow 107. A flywheel 110 is rotatably fastened to the upper frame 102 connected to drive means, as a belt or a chain 111 which via a cog or sprocket 112 transfers motion to the flywheel 110 through a crank 113 with pedals 114 and 115 (not visible). The drive means are mechanically the same as disclosed relative to FIGS. 1-5 and is therefore not shown in much detail on the figures and thus will not be commented any further. A seat 117 is fixed on the upper frame 102 in a familiar manner.

The apparatus has a steering gear and handlebar 123 where a steering rod 124 is rotatably connected to the upper frame 102, the angle of rotational axis 127 approximately 20 degrees relative a vertical axis 128 the rotation of steering rod 124 when turning the handle 123 is indicated by arrow 125, relative to the frames 101, 102. Steering rod 124 has a cross member 126 to which is towards each end is attached with springs or cylinder dampers.

To the lower part of and on two sides of the steering rod 124 is movably fastened two springs 130 and 131 (shown in FIGS. 6 and 7), or cylindrical dampers 132, 133 (shown in FIG. 8) the dampers either being of hydraulic type or gas type. The springs are at a stretched tension fixed to cross member 126 and fixed to the curved front part of frame 101'. The springs 130, 131 are configured to have a force capable of keeping the upper frame 102 in an upright neutral position when not in use, as seen on FIG. 6. When a person is sitting on the seat 117 with feet on pedals the weight of the person will force the frame to tilt to one or the other side, one of springs 130 or 131 being compressed the other stretched. To make the upper frame 102 balance in an upright neutral position the handlebar 123 is turned, as indicated by arrow 125 towards the direction of tilt. The springs 130, 131 will then be forced in a situation where at one side compressed and on the other side stretched forcing the steering rod 124 and frame 102 in an opposite direction of tilt, thus moving the frame 102 and person in an upright neutral position, or to an opposite tilt direction. FIG. 8 shows the second embodiment of the invention as shown in FIGS. 6 and 7 but where springs 130, 131 are replaced with cylinder dampers 132, 133, producing the same effect as disclosed in above text relative to said FIGS. 6 and 7. The connection of dampers 132, 131 to crossbar 126 and frame 101' being of a type ball bearing, allowing each of the dampers when stretched or compressed vertically like, move independently relative to a horizontal like direction.

Alternative embodiments regarding the tilt action of the inventive exercise cycle is shown in the following FIGS. 9-12. As springs 130 and 131 (shown in FIGS. 6 and 7), or cylindrical dampers 132, 133 (shown in FIG. 8) are fixed in a vertical like fashion, FIGS. 9-11 show a solution where springs 160, 161 are connected on a frame 162 fixed to the front frame part 101, the springs horizontally tensioning the steering rod 124, this having a protruding part 164 fixed in between the horizontal springs 160, 161, off centred relative to the swivel axis of the steering gear and steering rod. Tilting of the upper frame is counteracted when turning the steering rod as earlier described. FIG. 11 show an illustration where the springs 160 and 161 have means for adjustment, threaded bolts 165, 166 protruding the springs have knobs 167, 168 which when turned can adjust the tension of the springs, thus affecting the tilt action of the inventive exercise bicycle.

FIG. 12 shows yet another embodiment for the tilt action of the invention. A leaf spring 170 is fixed to the steering rod 124, off centred relative to the swivel axis of the steering gear and steering rod, and located between protruding parts 171, 172 fixed to the front part of frame 101'. The effect of tilt action as earlier described.

FIG. 13 shows the embodiment of the invention described above relative to FIG. 7 with a similar tilt action shown in FIGS. 9-11. Springs 200 as illustrated on FIG. 14*a* are located horizontally connected to front frame 101' and to a middle bar 202. The bar 202 is slideable located on lower part of steering rod 124, the bar 202 connected with a threaded bolt 205 and knob 206. Turning knob adjusts the positioning of springs 200 relative to swivel axis 210 of steering rod 124. If springs are in a position as indicated by numeral 215 and as illustrated on FIG. 14*c*, the spring connecting point to steering rod 124 will be inline swivel axis 210 of steering rod 124. This situation not giving the user much control of the tilt of frame 102 when turning handlebar 123. When knob 206 is turned the springs are moved along axis 207 and may be positioned at 213 or 214 seen on FIG. 13, also illustrated on FIGS. 14*a* and 14*b*. On FIG. 15 a solution using rubber springs 211, 211 is shown.

FIG. 16*a* shows a side view of a fourth embodiment of the invention representing an indoor exercise cycle apparatus, commonly known as a spinner. A frame 180 is rotary connected to a lower frame 181 configured to be placed on the floor. The lower frame has located at one rear end a stiff axle 182 on to which the upper frame 180 is connected, the axle dimensioned to carry all the weight and load of upper frame with steering gear, and bar 183, 184, seat 185, flywheel 186, crank 187 and all other parts, plus the weight of user, the construction being cantilever. The axle 182 is placed at an incline towards the front end of the cycle and at a forward part of axle has a vertically downwardly protruding part 188 to which springs 189, 189' are connected. The springs are of coil type or of rubber type. The steering gear 183 is rotary connected to upper frame piece frontal end, the axis being vertically but at an angle as suggested on the embodiments disclosed above. To the bottom part of steering gear 183 is located an adjustable bar 191 with bracket 191' for fixing springs 189, 189'. The adjustment is done along axis 178 in the manner described above with reference to FIGS. 13 and 14 by turning knob 192. Numeral 197 indicate means for resistance as known from prior art. FIG. 16*b* show an alteration to the fourth embodiment, frame 181 having a joint 193 at base of frame, allowing the frame parts 181' and 180 to tilt forward. The movement is controlled by rubber, spring, and or cylindrical hydraulic or gas damper 194. This allows a solution where the cycle apparatus has a spring action allowing a certain vertically movement, indicated by arrow 195 for the upper part of the apparatus. FIG. 17 shows a partly exploded view of the fourth embodiment, and FIG. 18 shows details of the cycle's steering gear balance system.

The following will describe a fifth embodiment of the invention with reference to accompanying FIGS. 19*a*-19*b* and 20*a*-20*b*. This embodiment uses weight instead of springs in order to control the tilt action of the invention. As seen on FIGS. 19*a*-19*b* the invention represents an indoor stationary exercise cycle, including a first lower frame 221 stable relative to a floor, which supports a second upper frame 222, which is tiltable attached to the first frame 221. The second upper frame 222 is tiltable through axis 224 relative to the first lower frame and the floor, bearings (not shown) connecting the two frames 221 and 222 at the rear part of the frame in a cantilever manner, the bearings being of for example slide bearings, pin or ball bearings. The tilt axis 224 has an incline relative to the floor. Tilt motion is indicated by arrow 227. A flywheel 230 is rotatable fastened to the upper frame 222 connected to drive means, as a belt or a chain 231 which via a cog or sprocket 232 transfers motion to the flywheel 230 through a crank 233 with pedals 234 and 235. A seat 237 is fixed on the upper frame 222 in a familiar manner.

The apparatus has a steering gear and handlebar 243 where a steering rod 244 is rotatably connected to the upper frame 222. To the rear part of steering rod 244 under frame 222 and tilt axis 224 a weight 246 is fixed. When in use the upper frame 222 will tilt and by rotating the handlebar 243 to the side of tilt, weight 246 is shifted in opposite direction and so forcing the frame to upright and in an opposite tilt direction. As FIG. 16*a* and FIG. 16*b* if upper frame 222 tilt to the left, illustrated by arrow 250, handlebar is turned towards left 251, the weight 246 shifting to the right 252, thus forcing frame 222 upright towards right. 248 denotes an adjustment knob which is connected with a threaded bolt through the steering gear 244 and to the weight 246 for adjusting the positioning of the weight 246 relative to the rotational axis of the steering gear.

It should be apparent to anyone familiar with the art that the weight positioning on the exercise cycle steering gear can vary from what is shown without departing from the scope of the invention.

No prior art or the present invention has a velocity in a forward direction relative to the floor or ground (EARTH) as a bicycle will achieve, but the flywheel of the prior art and present invention will give a gyroscopic effect simulating the motional direction, and velocity of the wheels of a bicycle in a forward motion.

For a user of the exercise cycle according to the invention it would be advantageous to have the option to adjust its tilt function or simply to lock the upper frame in a fixed position if the tilt function is not desired. There are many ways of doing this as anyone familiar with the present art will see, but in this case as a plausible solution here is provided a lock bolt and knob 140 which is rotationally threaded through frame 102, which is fitted in to a hole 141 in frame 101'. FIG. 7 shows the bolt 140 locking frame 102 to frame 101, 101' preventing tilt motion. Turning the knob and bolt 140 will release it from engagement with frame 101' as indicated by arrows 144, 145 on FIGS. 6 and 7.

The exercise cycle according to the invention has a system providing resistance to the rotation of the flywheel, thus creating resistance to the user of the apparatus. The mechanism, here indicated by number 150, on FIG. 6 may be of prior art of which technical means is used on ergometer cycles and spinning cycles today on the market. Usually this being a kind of braking system using a belt or brake shoe on a wheel or disc surface, or of an electromagnetic system which affects directly the flywheel, such as an eddie current brake system. As anyone familiar with prior art would know, a resistance mechanism would be connected with an interface console 160 preferably having a CPU and a screen, from where a user would monitor and adjust tasks and options, the system also having a sensor 151, which reads the rotation of the flywheel 110. Such a system is adaptable to the present invention with reference to prior art.

With reference to FIGS. 21-24, a sixth embodiment of the invention will be described. FIG. 21 shows a side view of the said embodiment, which is similar to what is shown in FIGS. 16-18, apart from means 270 for adjusting the incline of the upper part of frame 180, as indicated by arrow 272. Means 270 for adjusting the incline comprise either of a motor, preferably electric, a motor and gears, or by use of a hydraulic system. As suggested on FIG. 21 the upper frame part is fixed to a gear 273 which may be driven by an electric motor 274. The motor is powered by batteries or directly from the mains and is controlled by the user and or a computer which together with a screen and means for input forms a Human Machine Interface system, which preferably is formed as a console 275 (herein referred to as interface console) on an upper part of the training cycle.

FIG. 23 shows a block schematic, which illustrate the human interface structure of the invention. An interface console 300 (ex 275) comprise a CPU 301, means for display 302 and input 303. Power controller 304, which control power from batteries or from the mains, is connected with the CPU 301 which signals the power controller distribution of power to motor 305 for incline adjustment and action, and resistance to flywheel 306. A sensor 308 is located at rotational means 309 on cycle frame for reading of incline angle. The motor 305 may be signalled from the interface console 300 to adjust the incline of the apparatus frame 310. This applies to a function making different angles of the upper frame 310 for simulating a movement of the apparatus cycling up and down hill, as for a mobile bicycle on road or in terrain. The CPU of the training cycle will have a variety of programs 312 which simulate different terrains. The CPU will signal motor 305 to adjust incline according to the terrain a program is simulating, and signal resistance mechanism 307 to add resistance when a hill climb is run in the program 312. The resistance or brake mechanism 307 can be of an electromagnetic type, such as an Eddie-current brake system.

The function for incline control applies to the sixth embodiment of the invention, and it should be noted that all other functions described relative to FIG. 23 applies to all embodiments in this application.

The user may adjust the exercise apparatus to any desired resistance, independently of any programs using the interface console 300, which has a screen and means for input, the mechanism creating resistance 307 is activated at desired level. The exercise apparatus also has a sensor 313 which measures the revolutions of the flywheel 306, and which is connected to the CPU 301 for computing the revolutions to simulate distance, and to compute amount of training relative to a time unit.

FIG. 24*a* shows the sixth embodiment in a downhill position; FIG. 24*b* shows it in an up-hill position. Adjustment means is here suggested to be a rotary motor 270, which connects directly upper and lower frame.

The invention provides the user with an indoor training and exercise cycle which simulate a two wheeled mobile bicycle which during use is easy to adjust according to the users needs and desires of instability and resistance.

The invention claimed is:

1. A training apparatus to enable an apparatus user to perform physical exercise, and for use in rehabilitation of injuries and increased balance of the user, the apparatus having the configuration of a stationary exercise bicycle, the apparatus comprising a first, lower, supportive and stationary frame configured to rest with a part thereof on a floor, the frame at a rear end having an upwardly extending part, a second frame transversely tiltable relative to the first frame about a common axis at an upper region of the upwardly extending part, the axis extending in a longitudinal direction of the frames, the second frame being rotationally connected to the first frame on a cantilevered axle fixedly attached to the first frame at a rear end of the axle, and the second frame having a forward unsupported end and a steering gear turnable relative to said forward end and solely in engagement with the second frame at the forward unsupported end, the steering gear including handlebar means to enable the apparatus user to control a tilt movement of the second frame relative to the first frame.

2. A training apparatus to enable an apparatus user to perform physical exercise, and for use in rehabilitation of injuries and increased balance of the user, the apparatus having the configuration of a stationary exercise bicycle, the apparatus comprising a first, lower, supportive and stationary frame configured to rest with a part thereof on a floor, the frame at a rear end having an upwardly extending part, a second frame transversely tillable relative to the first frame about a common axis at an upper region of the upwardly extending part, the axis extending in a longitudinal direction of the frames, the second frame being rotationally connected to the first frame on a cantilevered axle fixedly attached to the first frame at a rear end of the axle, and the second frame having a forward unsupported end and a steering gear turnable relative to said forward end and solely in engagement with the second frame at the forward unsupported end, the steering gear including handlebar means to enable the apparatus user to control a tilt movement of the second frame relative to the first frame, and springs extending on either side of the axle between an engagement member in the form of a protrusion on the cantilevered axle at a forward end thereof and a respective bar shaped spring engagement member fixedly attached on the steering gear on either side of the axle.

3. A training apparatus according to claim 2, wherein the steering gear having attached thereto a movable bar to which the springs are attached at a rear end, positioning of the bar in a longitudinal direction of the apparatus being decisive of momentum on the springs relative to steering gear, such that the level of balance control for turning the steering gear is adjustable.

4. A training apparatus according to claim 2, wherein said springs are of a coil type or of an elastic, rubber-like material.

5. A training apparatus to enable an apparatus user to perform physical exercise, and for use in rehabilitation of injuries and increased balance of the user, the apparatus having the configuration of a stationary exercise bicycle, the apparatus comprising a first, lower, supportive and stationary frame configured to rest with a part thereof on a floor, the frame at a rear end having an upwardly extending part, a second frame transversely tiltable relative to the first frame about a common axis at an upper region of the upwardly extending part, the axis extending in a longitudinal direction of the frames, the second frame being rotationally connected to the first frame on a cantilevered axle fixedly attached to the first frame at a rear end of the axle, and the second frame having a forward unsupported end and a steering gear turnable relative to said forward end and solely in engagement with the second frame at the forward unsupported end, the steering gear including handlebar means to enable the apparatus user to control a tilt movement of the second frame relative to the first frame, wherein an angle of the cantilevered axle relative to the horizontal and the upwardly extending part of the first frame to which the cantilevered axle is fixed and protrudes from has a rotary connection to a horizontal part of first frame such that the inclination of the second frame is adjustable.

6. A training apparatus according to claim 5, wherein a damper is attached between said upwardly extending and horizontal parts of the first frame, said damper allowing limited movement in the upwardly extending direction of the second frame relative to the first frame.

7. A training apparatus according to claim 6, wherein said damper is selectable from: a spring damper, a gas spring damper and an hydraulic damper.

8. A training apparatus for performing physical exercise, and for use in rehabilitation of injuries and increased balance, the apparatus designed as a stationary exercise bicycle, the apparatus comprising a first, lower, supportive and stationary frame and a second frame transversely tiltable relative to the first frame about a common axis extending in a longitudinal direction of the frames, wherein the second frame is rotationally connected to the first frame on a cantilevered axle fixedly attached to the first frame, wherein the axle is attached to the first frame at a rear end thereof, and wherein the second frame has a steering gear including handlebar means for controlling a tilt movement of the second frame relative to the first frame, wherein springs extend between an engagement member in the form of a protrusion on the cantilevered axle and a bar shaped spring engagement member on the steering gear having ends on either side of the axle, and wherein, the steering gear having a movable bar to which the springs are attached, and positioning of the bar in a longitudinal direction of the apparatus being decisive of momentum on the springs relative to the steering gear, whereby the level of balance control for turning the steering gear is adjustable.

* * * * *